US005474001A

United States Patent [19]

Tajima et al.

[11] Patent Number: 5,474,001

[45] Date of Patent: Dec. 12, 1995

[54] MULTI-HEAD EMBROIDERY MACHINE

[75] Inventors: Ikuo Tajima; Minao Fukuoka; Takashi Ito; Satoru Suzuki, all of Kasugai, Japan

[73] Assignee: Tokai Kogyo Mishin Kabushiki Kaisha, Kasugai, Japan

[21] Appl. No.: 199,353

[22] Filed: Feb. 18, 1994

Related U.S. Application Data

[63] Continuation of Ser. No. 828,965, filed as PCT/JP91/00809 Jun. 17, 1991, abandoned.

[30] Foreign Application Priority Data

Jun. 18, 1990 [JP] Japan ..... 2-158913
May 23, 1991 [JP] Japan ..... 3-149476

[51] Int. Cl.[6] ..... D05C 9/04; D05B 21/00; D05B 25/00

[52] U.S. Cl. ..... 112/102.5; 112/103; 112/155; 112/220; 112/470.06

[58] Field of Search ..... 112/98, 102, 103, 112/155, 220, 241, 235, 121.12, 163, 121.11, 221, 96, 78, 255

[56] References Cited

U.S. PATENT DOCUMENTS 3,783,811 1/1974 Schmedding et al. ..... 112/155 X
4,215,641 8/1980 Dobrjanskyj et al. ..... 112/255 X
4,531,467 7/1985 Golia, Jr. et al. ..... 112/155
4,690,081 9/1987 Castagna et al. ..... 112/220 X
4,924,789 5/1990 Tajima et al. ..... 112/155 X
4,932,342 6/1990 Hisatake et al. ..... 112/155 X
4,936,232 6/1990 Monma ..... 112/155 X

*Primary Examiner*—Peter Nerbun
*Attorney, Agent, or Firm*—Dennison, Meserole, Pollack & Scheiner

[57] ABSTRACT

In an embroidery machine according to the present invention, at least one of driving mechanisms required for embroidery sewing has a driving source independent of the other driving mechanisms, and a control device is provided to control the driving source and those of the other driving mechanisms to be synchronously driven. With this construction, as for the driving mechanism having the independent driving source, since an interlocking mechanism can be omitted, the construction can be simplified, so that vibrations or noises can be reduced. Further with a control signal from the control device, a timing of operation of the driving mechanism having the independent drive source can be freely determined according to the embroidery mode.

10 Claims, 19 Drawing Sheets

MULTI-HEAD EMBROIDERY MACHINE

This is a continuation of application Ser. No. 07/828,965 filed as PCT/JP91/00809 Jun. 17, 1991, now abandoned.

TECHNICAL FIELD

This invention relates to an embroidery machine mainly for industrial use.

BACKGROUND OF THE INVENTION

An embroidery machine of this kind includes various kinds of driving mechanisms such as a needle bar driving mechanism, a hook shaft driving mechanism and a thread take-up lever driving mechanism which are required for sewing operation. For example, a multi-head embroidery machine having a plurality of sewing heads is constructed such that each of the driving mechanisms is operated by the rotation of a main shaft which extends through each of the sewing heads at a predetermined timing through an interlocking mechanism.

With the prior art embroidery machine, although it requires only one driving source, and interlocking mechanism is required for each driving mechanism, resulting in the construction being complicated. In addition, vibrations or noises which may be produced by the operation of each of the interlocking mechanisms cannot be disregarded. Further, vibrations and noises cause problems particularly in the multi-head embroidery machine.

Additionally, the timing of operation of each of the driving mechanism is mechanically determined by its related interlocking mechanism. Therefore, the timing cannot be freely changed according to change of a work to be sewn.

Object of the Invention

A technical object of the present invention is to provide an embroidery machine in which degree of freedom of timing of operation of each of drive devices is considerably increased; the number of interlocking mechanisms is minimized to reduce vibrations and noises; appropriate sewing operations can be performed according to change of a work to be sewn; and desired appearances can be obtained for the same work to be sewn.

Disclosure of the Invention

To attain the above object, an embroidery machine according to the present invention is constructed as follows:

At least one of driving mechanisms required for embroidery sewing has a driving source independent of the other driving mechanisms. A control device is provided to control the driving source and those of the other driving mechanisms to be synchronously driven.

Additionally, to attain the above object, an embroidery machine may be constructed as follows:

In a multi-head embroidery machine of the type having a plurality of sewing heads, at least one of driving mechanisms required for embroidery sewing has a driving source independent of the other driving mechanisms. A control device is provided to control the driving source and those of the other driving mechanisms to be synchronously driven. The independent driving source is a common driving source for all of the sewing heads.

Further, to attain the above object, an embroidery machine may be constructed as follows:

In a multi-head embroidery machine of the type having a plurality of sewing heads, at least one of driving mechanisms required for embroidery sewing has a driving source independent of the other driving mechanisms. A control device is provided to control the driving source and those of the other driving mechanisms to be synchronously driven. The independent driving source is provided for each of the sewing heads.

With the above construction, as for the driving mechanism having the independent driving source, since an interlocking mechanism can be omitted, the structure can be simplified and therefore, vibrations or noises can be reduced. Further, by a control signal from the control device, a timing of operation of the driving device having the independent driving source can be freely set according to the mode of embroidery.

Thus, since the interlocking mechanism is not necessary for the driving mechanism having the independent driving source, the embroidery machine can be simplified in construction and therefore, vibrations or noises can be reduced, and additionally, degree of freedom of timing of operation is considerably increased, so that it is possible to perform the sewing operation at high speed, and various tones or various appearances of the embroidery can be obtained.

Particularly, in case of the embroidery machine having the independent driving source for each of the sewing heads, the independent control can be performed for each of the sewing heads.

BRIEF DESCRIPTION OF THE DRAWINGS

Drawings show several embodiments of the present invention, in which FIG. 19 is a vertical sectional view of an embroidery machine having an additional function for sewing a cord or the like.

EMBODIMENTS

Embodiments of the present invention will now be described according to the drawings. The embodiments are those where the present invention has been applied to multi-head and multi-needle embroidery machines.

First Embodiment

Figure 4:
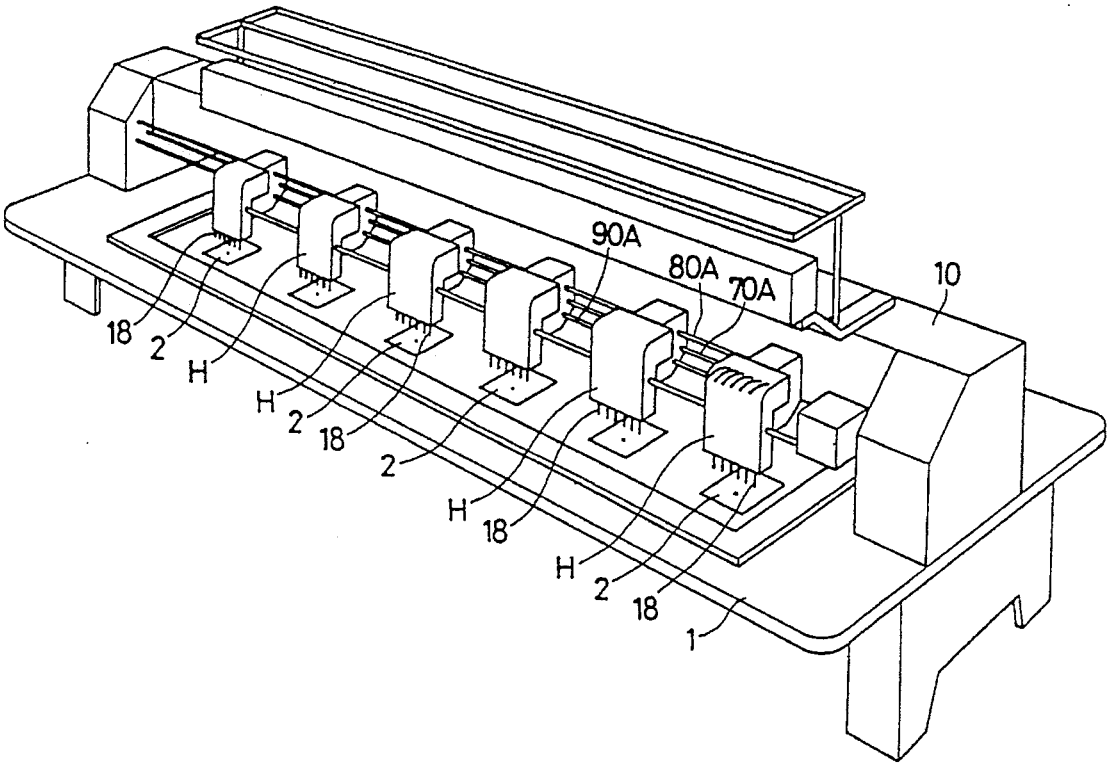
FIG. 4 is a perspective view showing the whole appearance of an embroidery machine.

A schematic appearance of an embroidery machine is shown by a perspective view in FIG. 4. As will be seen from FIG. 4, a plurality of sewing heads H (six in this figure) are mounted on the front side of a machine frame 10 disposed on a table i and are spaced from each other at a predetermined distance. The construction of each of the sewing heads H will now be explained.

Figure 1:
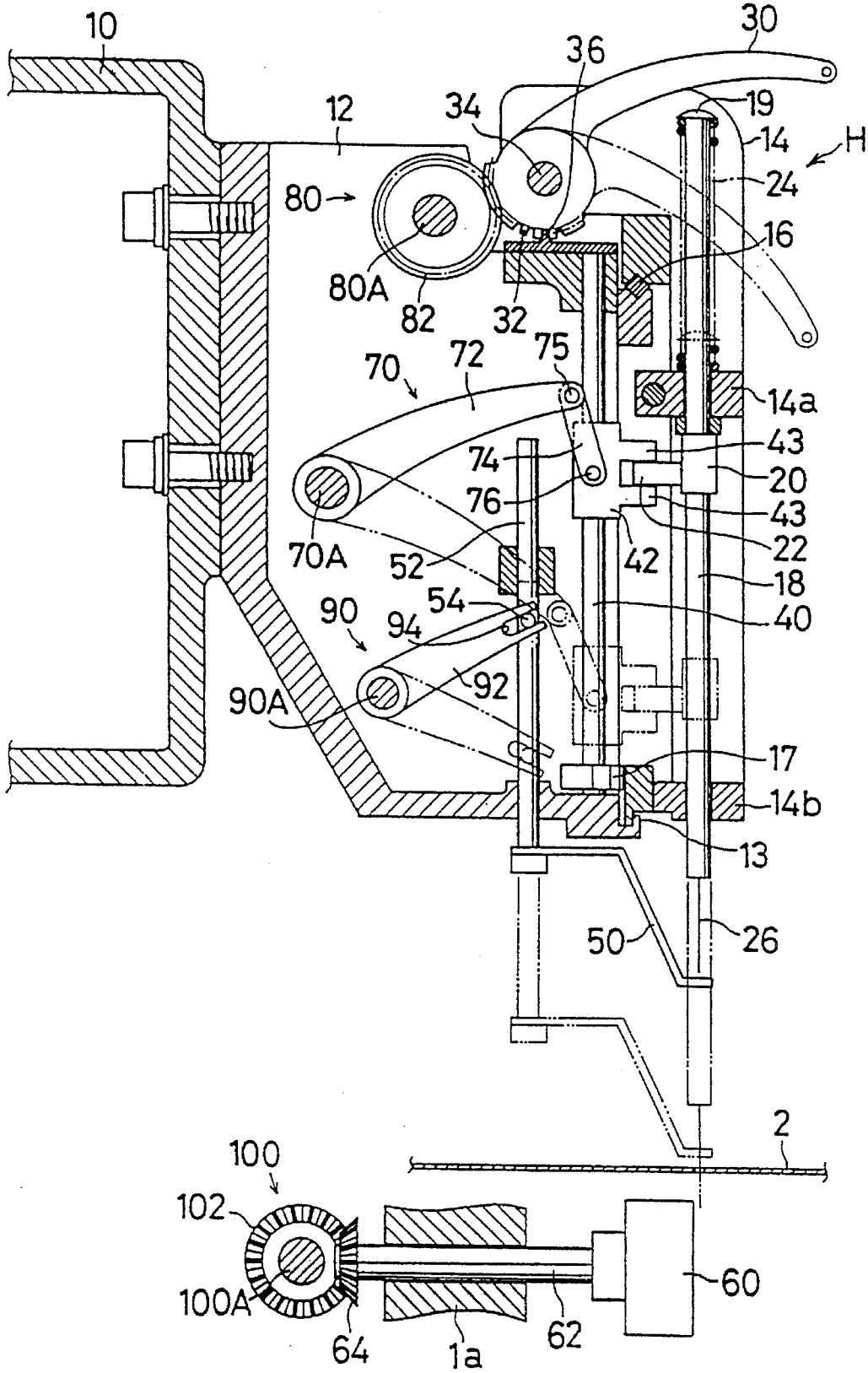
FIG. 1 is a vertical sectional view of a sewing head according to a first embodiment.
Figure 2:
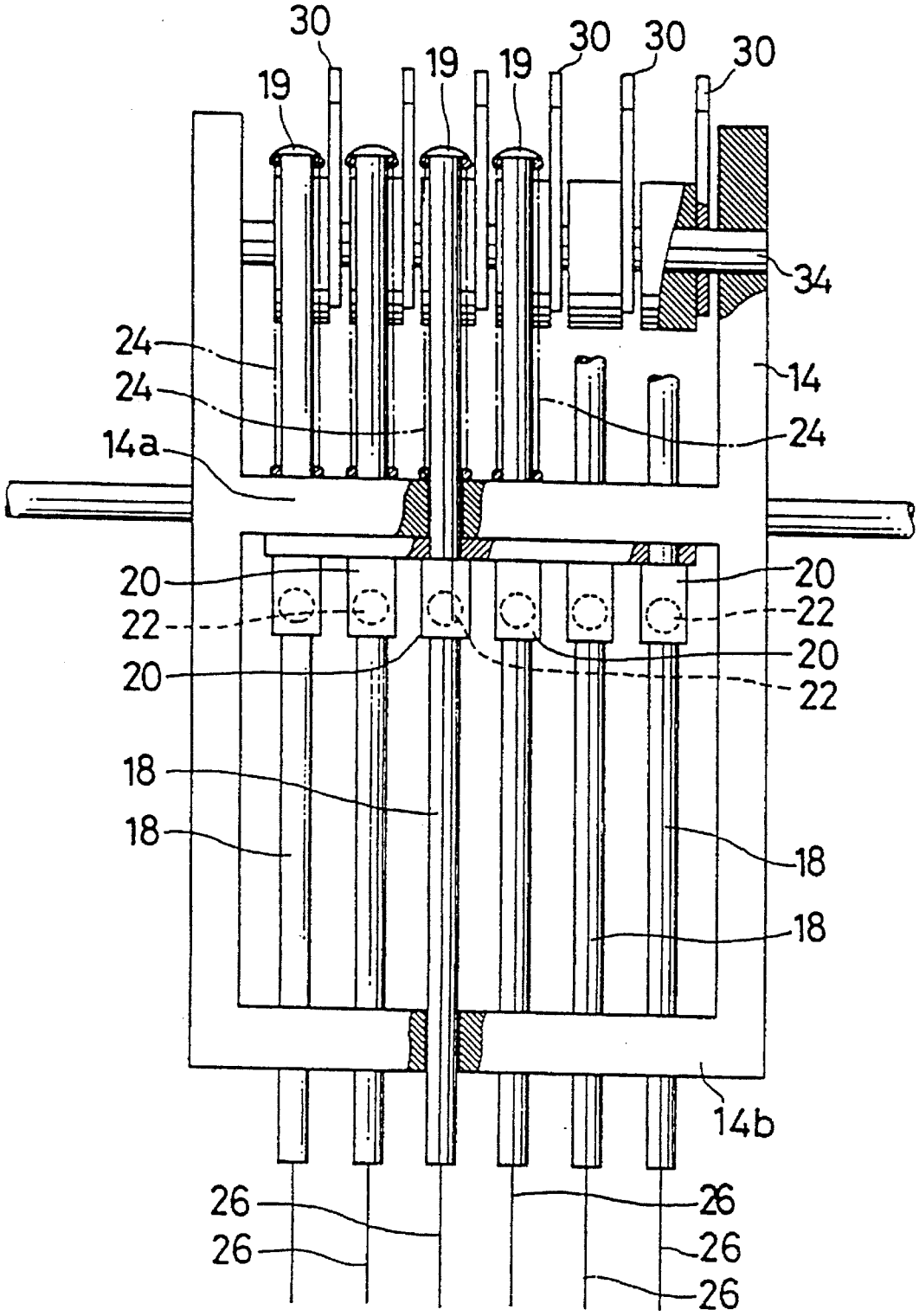
FIG. 2 is a front view of the sewing head according to the first embodiment.

One of the sewing heads H is shown by a vertical sectional view in FIG. 1 and is shown by a front view in FIG. 2. In these drawings, the sewing head H is provided with an arm 12 and a needle bar casing 14. The needle bar casing 14 is disposed on the front side (right side in FIG. 1) of the arm 12 and is slidably movable in a lateral direction in FIG. 2 through a radial bearing 17 and a guide portion 13 of the arm 12. The rear portion (left side portion in FIG. 1) of the arm 12 is fixed to the machine frame 10.

A plurality of needle bars 18 (six in this embodiment) are vertically movably mounted on the needle bar case 14 and are spaced from each other in the lateral direction at a predetermined distance. A needle bar connecting stud 20 is fixed to the middle portion of each of the needle bars 18 and is provided with a protrusion 22 on the left side in FIG. 1.

A needle bar support spring 24 is interposed between a spring seat 19 disposed at the upper end of each of the needle bars 18 and an upper surface of an upper horizontal frame 14*a* of the needle bar casing 14 for normally biasing the corresponding needle bar 18 in an upward direction. By virtue of resilient force of the spring 24, each of the needle bars 18 is kept at its upper dead point as shown by solid lines in FIGS. 1 and 2. A sewing needle 26 is mounted on the lower end of each of the needle bar 18.

As shown in FIG. 1, a needle bar base 40 is mounted on the arm 12 and extends in parallel to the needle bars 18. A driving member 42 is vertically movably mounted on the needle bar base 40. A pair of engaging protrusions 43 spaced from each other in the vertical direction are integrally formed with the driving member 42. The protrusion 22 of one of the needle bars 18 selected through aforementioned sliding movement of the needle bar casing 14 relative to the arm 12 is engageable between the engaging protrusions 43.

Thread take-up levers 30 are disposed within the needle bar case 14 at positions corresponding to the needle bars 18, respectively. Each of the thread take-up levers 30 is rotatably mounted on a thread take-up lever shaft 34 supported by the needle bar casing 14 at both ends thereof. Further, each of the thread take-up levers 30 is provided with a gear 32 having the same central axis as that of the thread take-up lever shaft 34.

As for the other thread take-up levers 30 than that corresponding to the aforementioned selected needle bar 18, a part of the gear 32 of each of them engages a thread take-up lever rail 36 fixed on the upper surface of the arm 12, so that the other thread take-up levers 30 are maintained at positions shown by solid lines in FIG. 1.

A presser foot shaft 52 is vertically movably mounted on the arm 12 at a position rearwardly of the needle bar base 40 (leftward in FIG. 1) and extends in parallel to the needle bar base 40. A presser foot 50 is fixed to the lower end of the presser foot shaft 52 below the arm 12. A pin 54 is fixed to the presser foot shaft 52.

Additionally, as is well known, a shuttle 60 is disposed below a throat plate 2 mounted on the table 1. A hook shaft 62 for rotating the shuttle 60 is rotatably supported by a frame 1*a* below the table 1, and a gear 64 is fixed to one end of the hook shaft 62.

Driving mechanisms of the embroidery machine or a needle bar driving mechanism 70, a thread take-up lever driving mechanism 80, a presser foot driving mechanism 90 and a shuttle driving mechanism 100 will now be explained. As will be apparent from FIG. 1, these driving mechanisms 70, 80, 90 and 100 include driving shafts 70A, 80A, 90A and 100A, respectively, and as shown in FIG. 4, the driving shafts 70A, 80A and 90A other than the driving shaft 100A extend through the sewing heads H, respectively. The driving shaft 100A of the hook driving mechanism 100A extends below the table 1.

Figure 3:
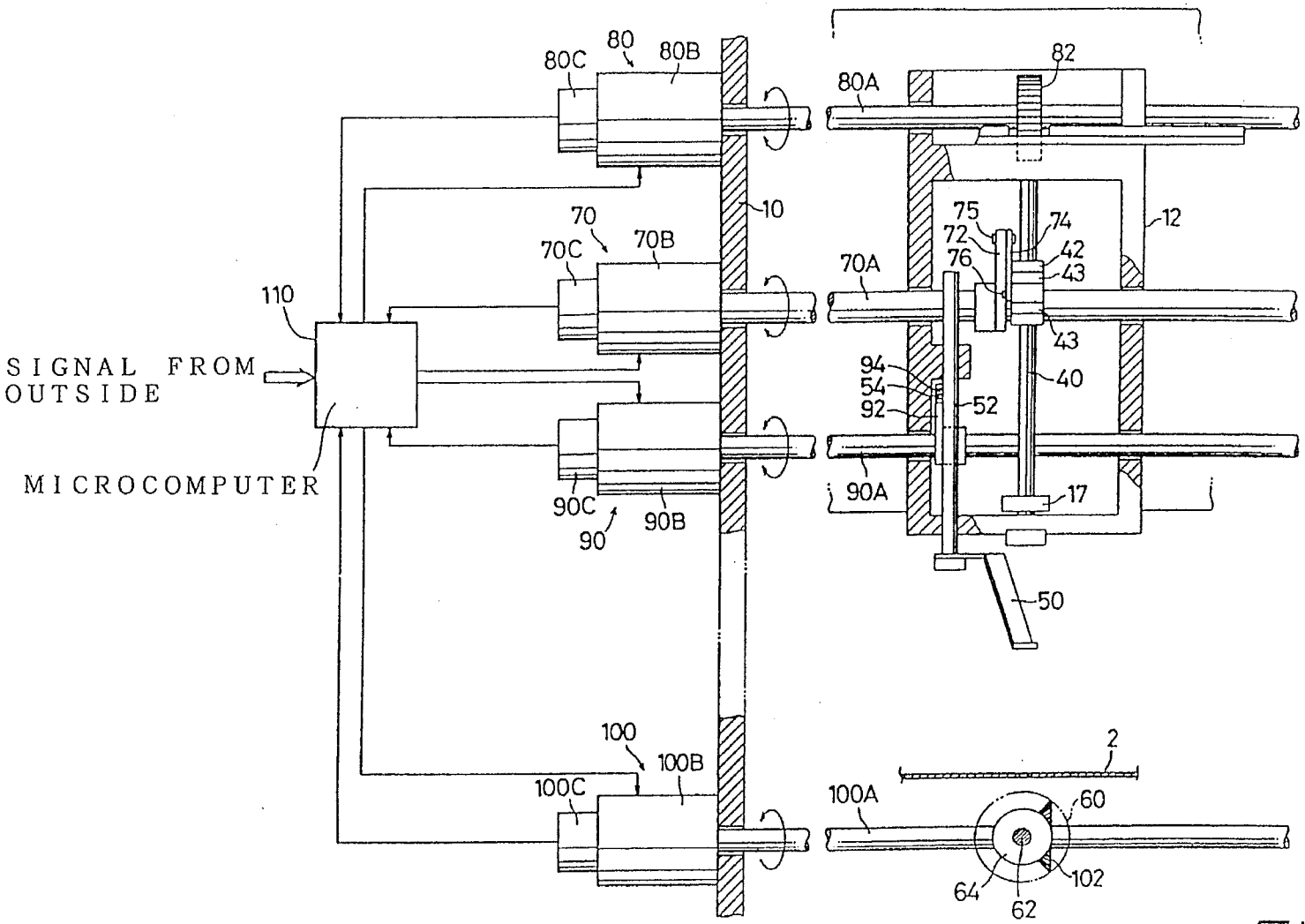
FIG. 3 is a sectional view, looking in the right-hand direction of FIG. 1, of driving mechanisms of the embroidery machine of the first embodiment.

The driving mechanisms 70, 80, 90 and 100 are shown in FIG. 3 as right side sectional views of FIG. 1. As will be seen from FIG. 3, the driving shafts 70A, 80A, 90A and 100A receive driving force from respective driving sources 70B, 80B, 90B and 100B such as servo-motors, independently of each other. Only the driving shaft 100A of the shuttle driving mechanism 100 is driven in one direction by the driving source 100B, while the other driving shafts 70A, 80A and 90A are driven in both forward and reverse directions by the driving sources 70B, 80B and 90B, respectively.

The driving mechanisms 70, 80, 90 and 100 include absolute encoders 70C, 80C, 90C and 100C, respectively. A signal from the encoder 100C of the shuttle driving mechanism 100 is used as an operation reference for the other driving mechanisms 70, 80 and 90.

A lever 72 is disposed within each of the sewing heads H and is mounted on the driving shaft 70A of the needle bar driving mechanism 70 in such a manner that the lever 72 rotates with the driving shaft 70A. The end portion of the lever 72 is connected to the driving member 42 through a link 74 and pins 75 and 76. Thus, the driving member 42 is vertically reciprocally moved along the needle bar base 40 as the driving shaft 70A rotates in the forward and reverse directions.

A drive gear 82 is fixedly mounted on the driving shaft 80A. A part of the thread take-up rail 36 is notched at a position forwardly of the drive gear 82 (rightwardly in FIG. 1). Thus, only the gear 32 of the thread take-up lever 30 positioned forwardly of the drive gear 82 through selecting operation of the needle bars 18 engages the drive gear 82 and is released from engagement with the thread take-up lever rail 36. Therefore, only the selected thread take-up lever 30 may rotate around the thread take-up lever shaft 34 by the reciprocal rotation of the driving shaft 80A.

A lever 92 is mounted on the driving shaft 90A of the presser foot driving mechanism 90 in such a manner that it can be rotated with the driving shaft 90A. An engagement recess 94 is formed at one end of the lever 92 and is in engagement with the pin 54 of the presser foot shaft 52. The presser foot 50 moves vertically together with the presser foot shaft 52 by the reciprocal rotation of the driving shaft 90A.

A drive gear 102 is fixedly mounted on the driving shaft 100A of the shuttle driving mechanism 100 and engages the gear 64 of the hook shaft 62. The shuttle 60 therefore rotates as the driving shaft 100A continuously rotates in one direction.

A control device 110 shown in FIG. 3 is constructed by incorporating a microcomputer and its related devices. The control device 110 outputs signals to the drive sources 70B, 80B and 90B for controlling operational positions of the driving shafts 70A, 80A and 90A relative to the position of the driving shaft 100A of the hook shaft driving mechanism 100, based on signals from the absolute encoders 70C, 80C, 90C and 100C of the driving mechanisms 70, 80, 90 and 100. The control device 110 may be assembled into a servo-control system or may be disposed outside of the same as the case may be.

Figure 5:
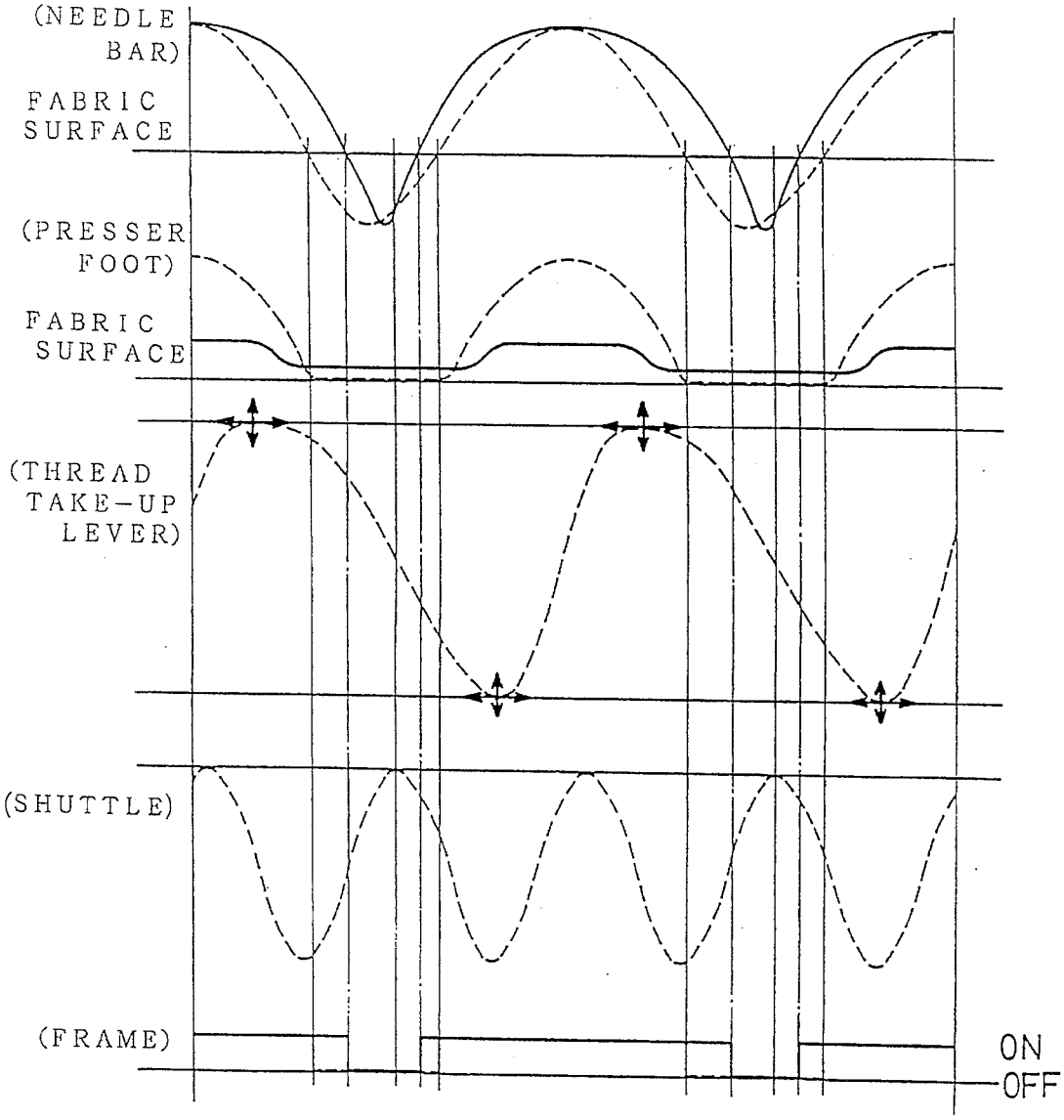
FIG. 5 is an explanatory view showing timings of operations of driving devices along with a timing of movement of frames.

FIG. 5 shows timings of operation of the driving mechanisms 70, 80, 90 and 100 as well as a timing for driving an embroidery frame. In the timing chart shown in FIG. 5, the dotted line shows the case of a conventional machine, while the solid line shows the case of this embodiment.

In the embroidery machine constructed as described above, when the needle bar casing 14 is slidably moved in the lateral direction in FIG. 2 relative to the arm 12 of the sewing head H, the protrusion 12 of the needle bar 18 thus selected engages between the engagement protrusions 43 and 44 of the driving member 42. Simultaneously with this operation, the gear 32 of the thread take-up lever 30 corresponding to the selected needle bar 18 engages the driving gear 82 of the thread take-up lever driving mechanism 80.

At this situation, the needle bar driving mechanism 70, the thread take-up lever driving mechanism 80 and the presser foot driving mechanism 90 are driven at predetermined timings as shown in FIG. 5 with the driving timing of the shuttle driving mechanism taken as a reference. Firstly, with regard to the needle bar driving mechanism 70, the driving member 42 reciprocally vertically moves along the needle bar base 40 according to the movement of the lever 72 which rotates with the driving shaft 70A.

Subsequently, as the driving shaft 80A of the thread take-up lever driving mechanism 80 rotates with the drive gear 82, the thread take-up lever 30 corresponding to the above selected needle bar 18 reciprocally rotates around the thread take-up lever shaft 34. Additionally, as the driving shaft 90A of the presser foot driving mechanism 90 rotates, the presser foot shaft 52 is vertically moved together with the presser foot 50 through the lever 92 which reciprocally rotates with the driving shaft 90A.

Since the driving mechanisms 70, 80, 90 and 100 are driven independently of each other, various advantages may be obtained.

As for the needle bar driving mechanism 70, as will be seen from FIG. 5, the period during which the needle bar 18 (the sewing needle 26) is positioned above the upper surface of a fabric to be sewn can be determined to have a long time. Therefore, this may provide sufficient time for the timing of movement of the frame. Further, the timing of the vertical movement of the needle bar 18 can be freely changed according to the kinds of sewing or works to be sewn.

Additionally, the rotational angle of the driving shaft 70A of the needle bar driving device 70 can be changed to adjust the stroke of vertical movement of the needle bar 18. Thus, during sewing operation, the vertical stroke can be determined as short as possible by lowering the position of the upper dead point of the needle bar 18, while during exchanging operation of the fabric, the efficiency of operation can be increased by greatly lifting the needle bar 18.

Figure 6:
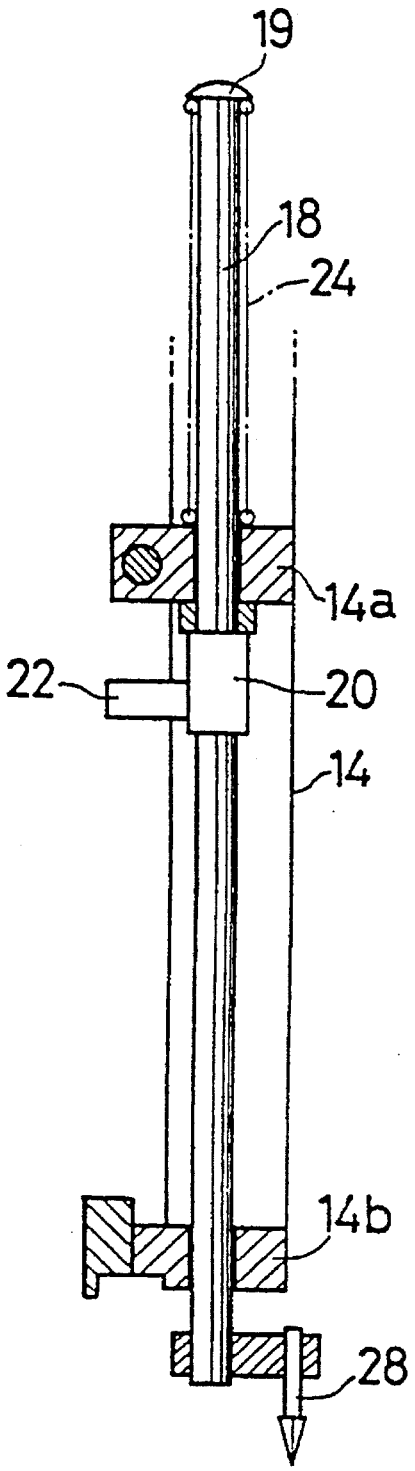
FIG. 6 shows a sectional view where one of needle bars is used for boring.

FIG. 6 shows a sectional view of an embodiment where a boring device 28 is mounted on one of the needle bars 18 within the needle bar casing 14. The boring device 28 is provided to bore the fabric through driving of the needle bar 18 and has a tapered configuration pointed at its extremity. The boring device 28 is mounted normally on the first needle bar 18 which is located in the most rightward position in FIG. 2.

By adjusting the vertical stroke of the needle bar 18 having the boring device 28 in such a manner as described above, the depth of sticking of the boring device 28 into the fabric can be changed. Thus, the size of a bore formed in the fabric by the boring device 28 through one vertical stroke of the needle bar 18 can be adjusted.

As for the thread take-up lever driving mechanism 80, by independently driving the same, the positions of upper and lower dead points of the thread take-up 30 and the motion thereof can be freely determined, so that the tightness of stitches can be adjusted in association with the timing of the vertical movement of the needle bar 18.

For example, with regard to the movement of the frame performed for each one stitch, it is preferable to start to move the frame after the thread take-up lever 30 has completely taken up an upper thread or after completion of forming of the stitch through entangling of the upper thread with a lower thread, and practically, general sewing machines are so operated. However, in case of embroidery sewing, since the length of one stitch is relatively large in many cases, the timing of starting of movement of the frame is determined relatively earlier. In the case where the frame is moved prior to completion of formation of the stitch, the finished stitch may suffer a harmful effect.

By way of contrast, in case of this embodiment, it is possible to determine the thread take-up lever to reach the upper dead point earlier or to determine the thread take-up operation to be completed earlier, so that the aforementioned problem can be solved. However, in this case, it is necessary to determine the timing for catching the upper thread earlier by increasing the rotational speed of the shuttle 60 (for example, by determining the shuttle 60 to rotate three times during one stroke of the needle bar 18 whereas in case the shuttle is conventionally rotated two times during one stroke).

Further, although the possibility of shrinkage of the work to be sewn through the sewing operation increases as the length of one stitch increases, such shrinkage may be prevented by changing the stroke of the thread take-up lever according to the length of the stitch or by increasing the stroke of the thread take-up lever in proportion to the length of the stitch.

As for the presser foot driving mechanism 90, an economical driving operation can be performed by determining the vertical stroke of the presser foot 50 as short as possible. Further, by determining the stroke of the presser foot 50 to the minimum required length and by determining the acceleration at the upper and lower dead points to minimum values, it can reduce vibrations and noises during sewing operation. This may be also applicable to the needle bar 18. Further, as is also the case with the needle bar 18, the presser foot 50 can be substantially lifted above the work to be sewn when the work to be sewn is exchanged.

As is the case with the work to be sewn which is made of leather or a fabric having relatively large thickness, the needle bar 18 undergoes a large resistance when it is moved upwardly to be extracted from the work to be sewn. In such a case, it is possible to delay the timing of upward movement of the presser foot 50 in such a manner that the fabric can be pressed enough until the sewing needle 26 has been completely extracted from the work to be sewn. This may prevent threads from being cut and make it easy to deal with the embroidery sewing of the leather or the fabric having a relatively large thickness.

Second Embodiment

Figure 7:
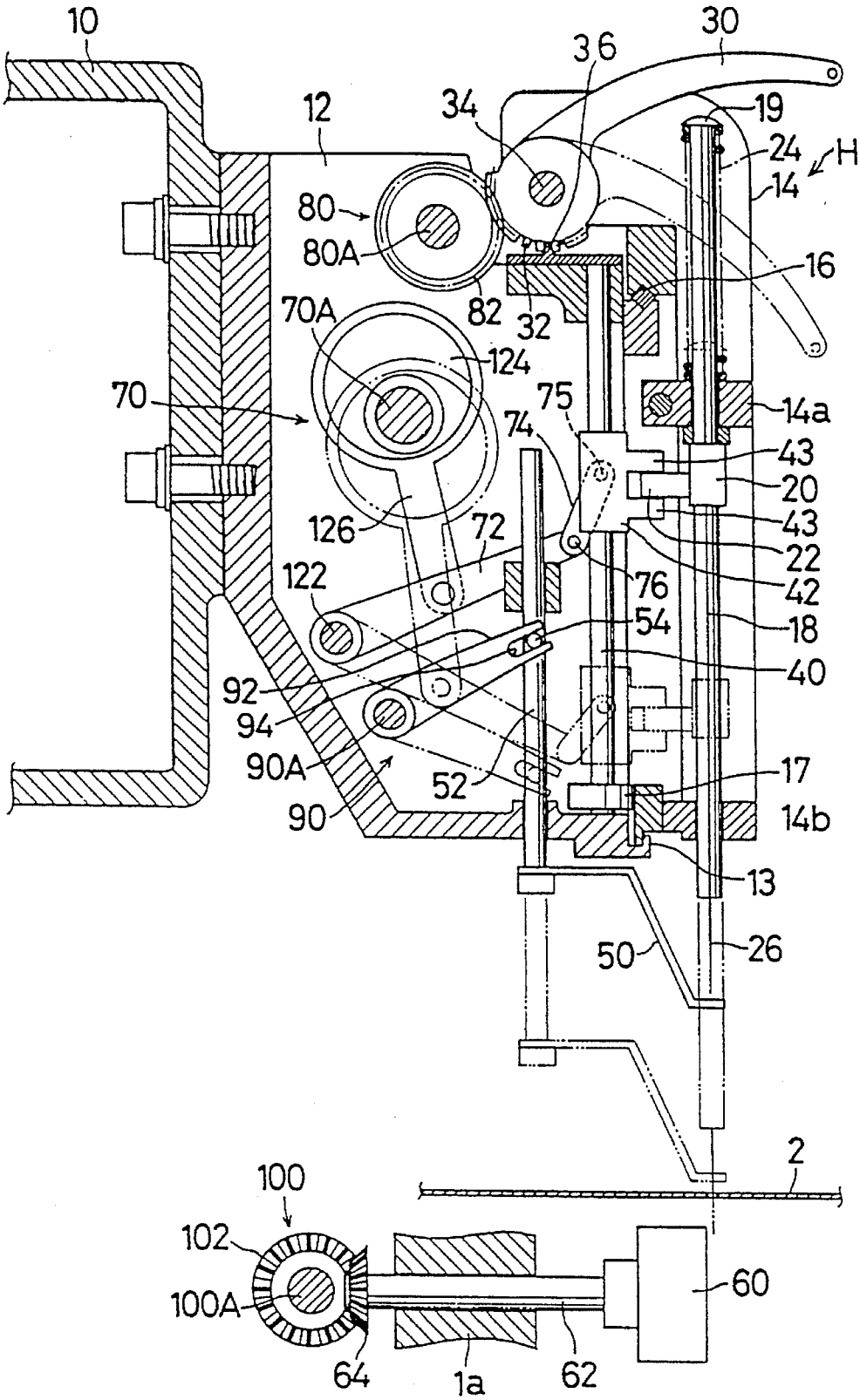
FIG. 7 is a vertical sectional view, corresponding to FIG. 1, of a sewing head of a second embodiment.
Figure 8:
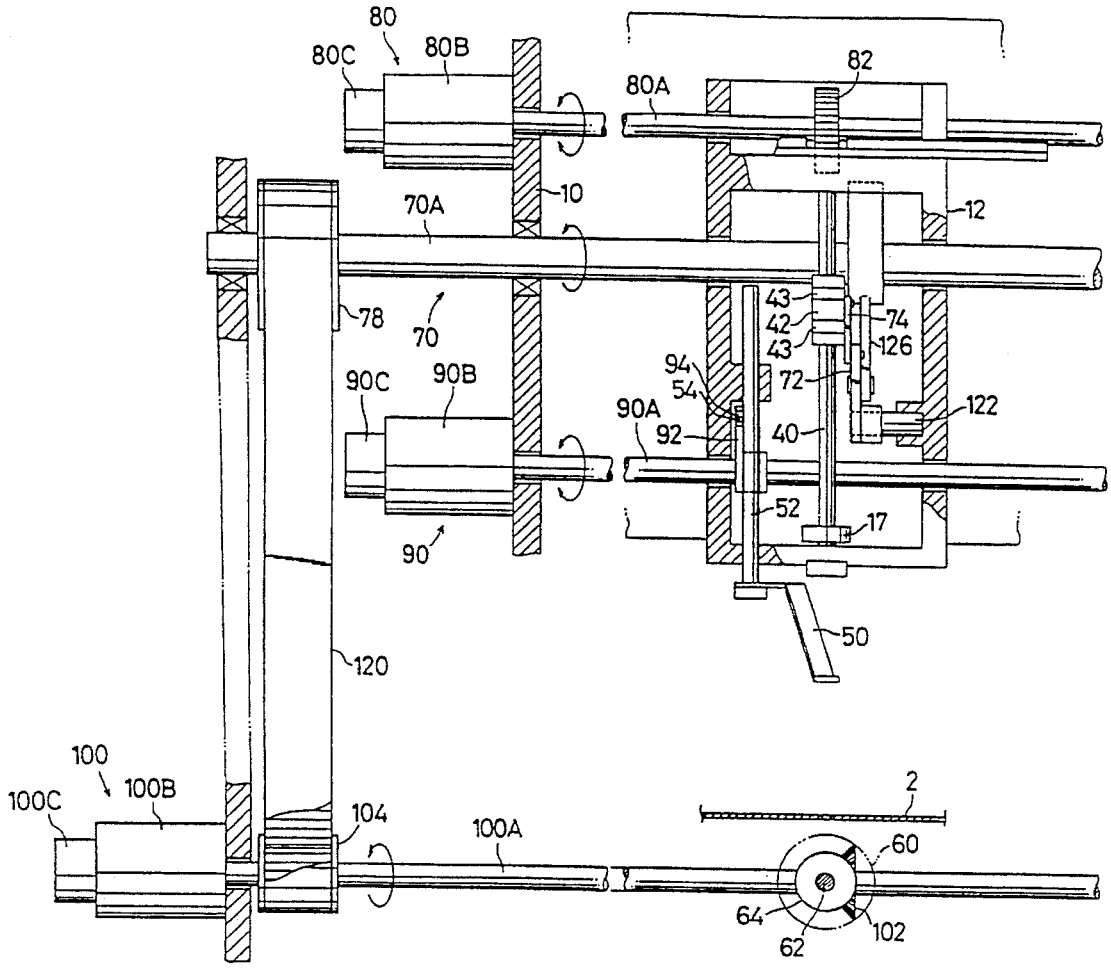
FIG. 8 is a sectional view, looking in the right-hand direction of FIG. 7, of driving mechanisms of the second embodiment.

The construction of a second embodiment is shown in FIGS. 7 and 8 which show sectional views corresponding to FIGS. 1 and 2, respectively. In this embodiment, as will be particularly seen from FIG. 8, a drive pulley 104 is mounted on a driving shaft 100A of a shuttle driving mechanism 100 in such a manner that it rotates integrally with the driving shaft 100A. In addition, a needle bar driving mechanism 70 is not provided with a driving source such as a servo-motor but is provided with a driven pulley 78 mounted on a driving shaft 70A. A timing belt 120 is tensioned between the drive pulley 104 and the driven pulley 78. Thus, with this embodiment, the needle bar driving mechanism 70 continuously rotates in one direction through interlocking with the driving shaft 100A of the shuttle driving mechanism 100.

In connection with this, a lever 72 of the needle bar driving mechanism 70 is pivotally mounted on a support shaft 122, and a cam 124 is mounted on the driving shaft 70A. A ring-like portion formed on one end of a connecting rod 126 is connected to an outer periphery of the cam 124. The other end of the rod 126 is connected to substantially the central portion of the lever 72 through a pin. Therefore, as the driving shaft 70A rotates, the lever 72 is pivoted around the support shaft 122 through the operations of the cam 124 and the connecting rod 126. The driving member 42 is reciprocally vertically moved along a needle bar base 40 as was described in connection with the first embodiment through interlocking with the pivotal movement of the lever 72.

Thus, with this embodiment, the needle bar driving mechanism 70 and the shuttle driving mechanism 100 are interconnected with each other, while only a thread take-up lever driving mechanism 80 and a presser foot driving mechanism 90 are independently driven.

It will be noted that, with the second embodiment, an explanation has been omitted with respect to the elements which are the same as or equivalent to those of the first embodiment, with the same numerals labeled to the drawings. Further, with a third embodiment and its subsequent embodiments, an explanation will be omitted in the same manner.

Third Embodiment

Figure 9:
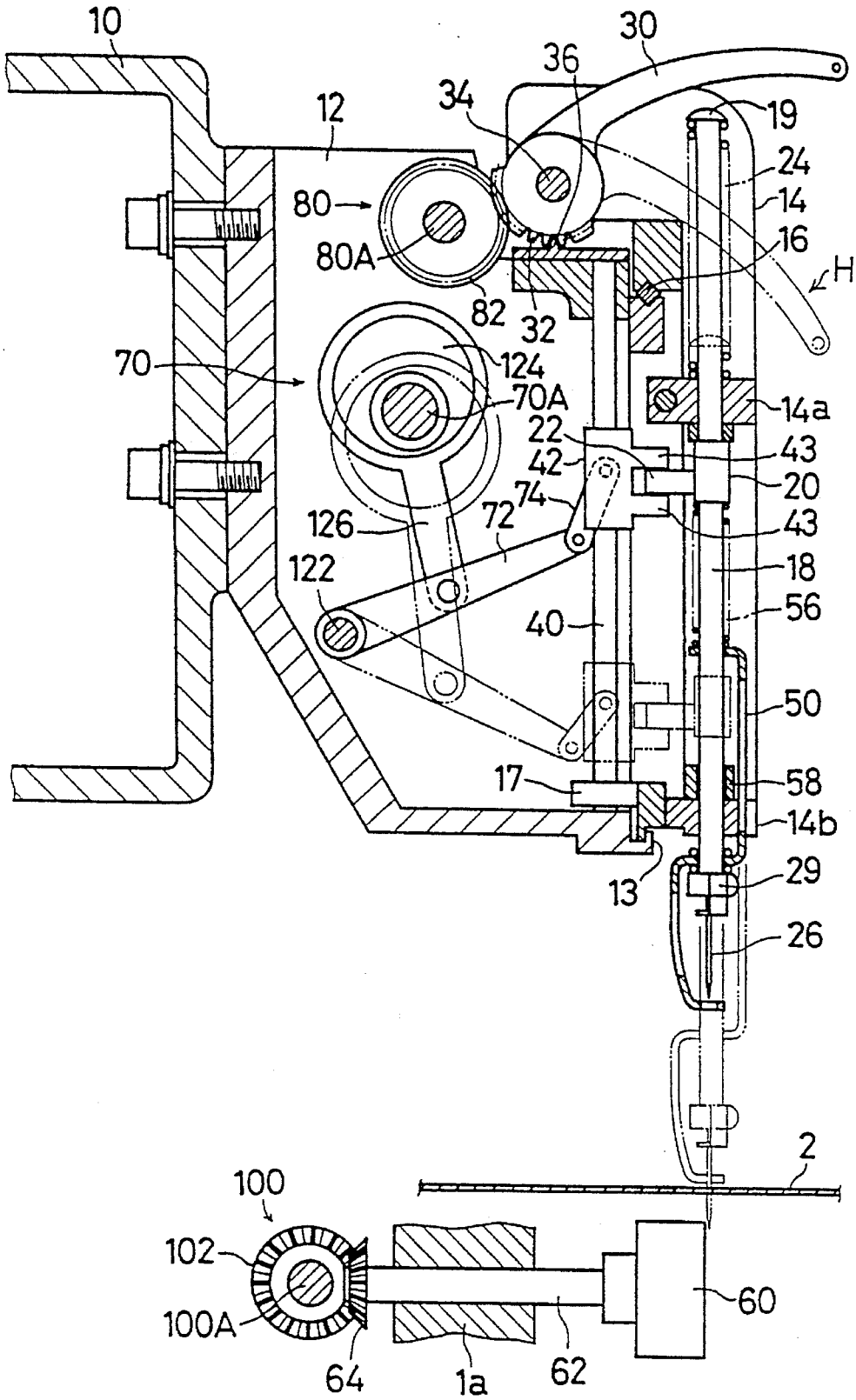
FIG. 9 is a vertical sectional view, corresponding to FIG. 1, of a sewing head of a third embodiment.
Figure 10:
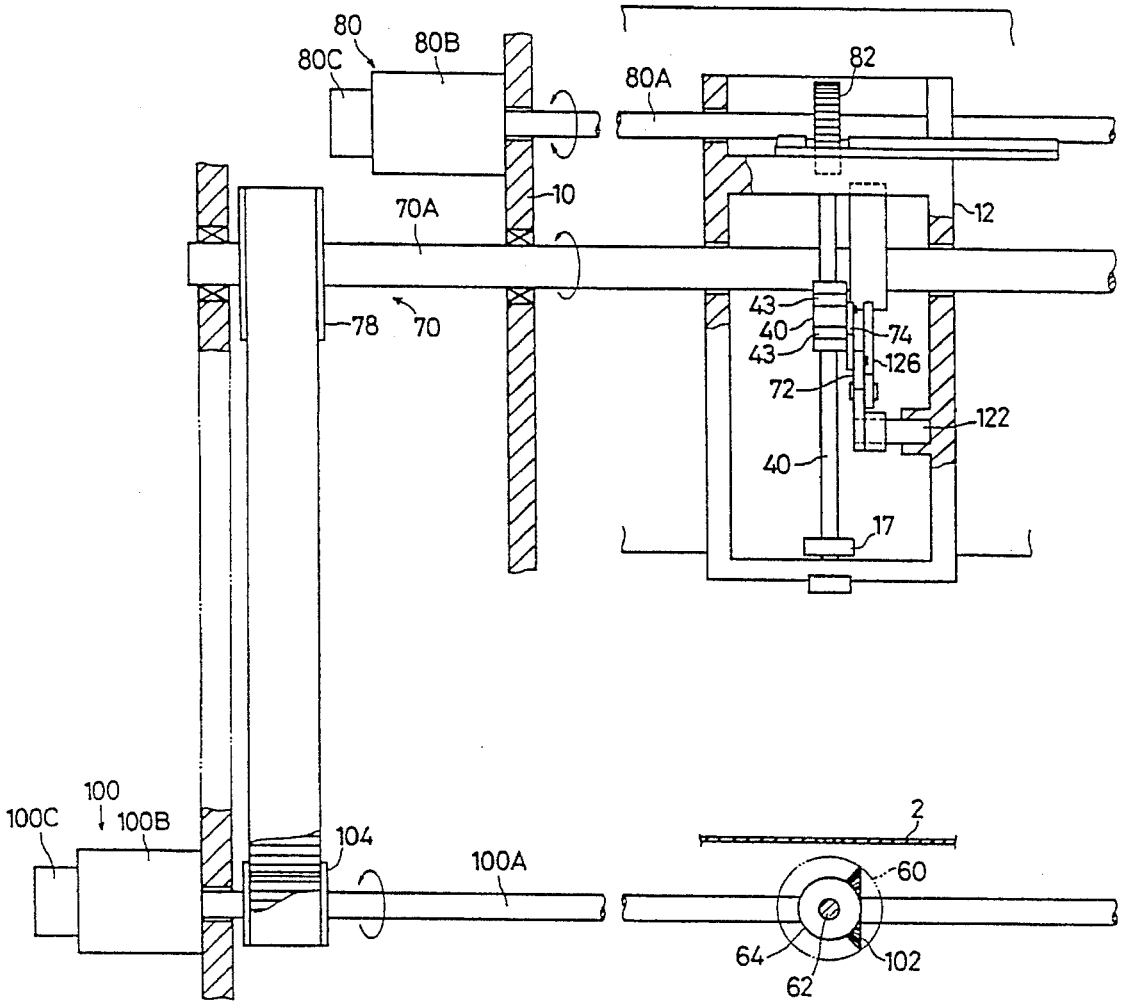
FIG. 10 is a sectional view, looking in the right-hand direction of FIG. 9, of driving mechanisms of the third embodiment.

A third embodiment is shown in FIGS. 9 and 10 by sectional views corresponding to FIG. 1 and FIG. 2. In the third embodiment, the presser foot driving mechanism 90 of the second embodiment is omitted. Thus, in this embodiment, a presser foot 50 is vertically movably mounted on each needle bar 18. A coil spring 56 is interposed between the presser foot 50 and a needle bar connecting stud 20 as previously described.

When the needle bar 18 is caused to move downwardly through interlocking with driving of a driving member 42, the presser foot 50 is also moved downwardly through the spring 56. After movement of the presser foot 50 has been restricted at a fabric pressing position through abutment on a lower dead point stopper 58 of a needle bar casing 14, only the needle bar 18 moves downwardly to reach a lower dead point through compression of the spring 56. When the needle bar 18 is moved upwardly, a needle clamp body 29 disposed at its lower end abuts on the presser foot 50, and thereafter, the presser foot 50 moves upwardly together with the needle bar 18.

Thus, with this embodiment, a needle bar driving mechanism 70 is interlocked with a shuttle driving mechanism 100 and the presser foot 50 is interlocked with the needle bar 18, and therefore, only a thread take-up lever driving mechanism 80 is independently driven.

Fourth Embodiment

Figure 11:
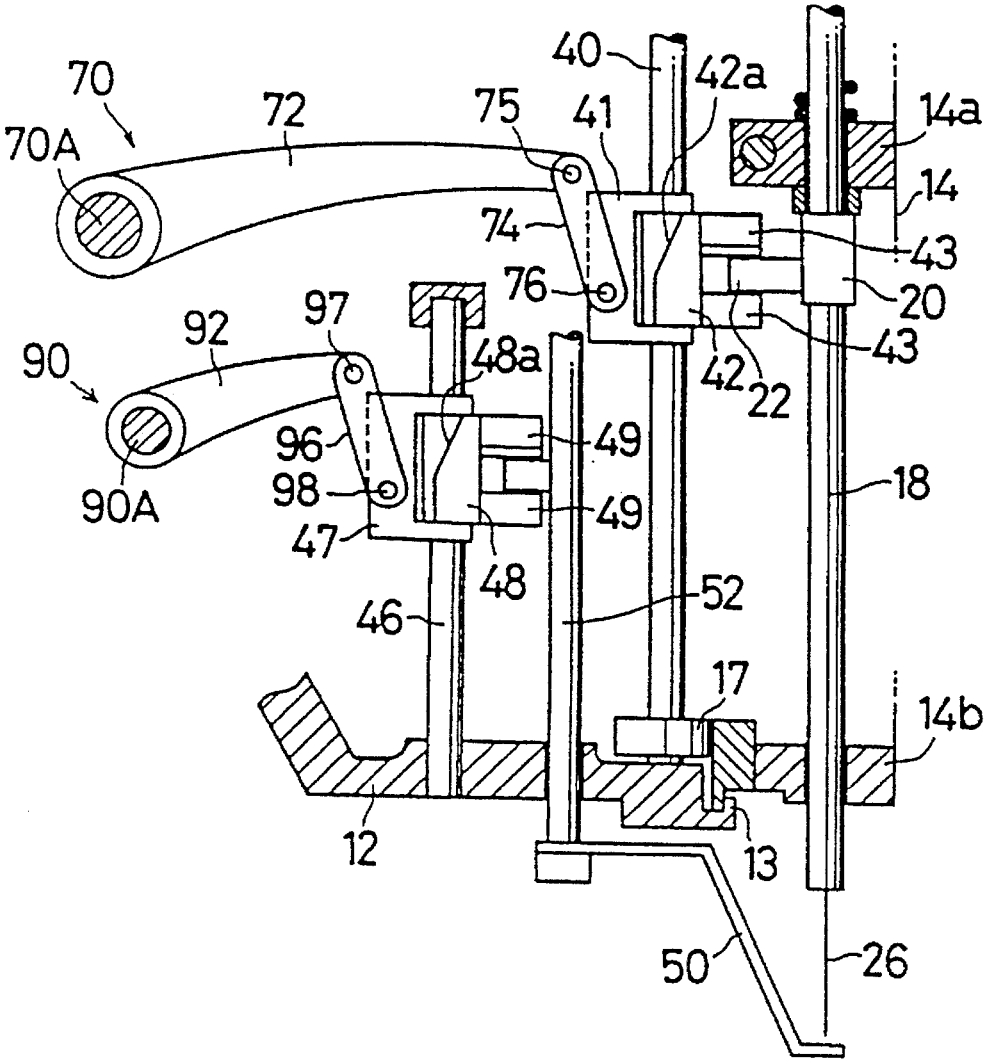
FIG. 11 is a vertical sectional view of a main portion of a sewing head of a fourth embodiment.
Figure 12:
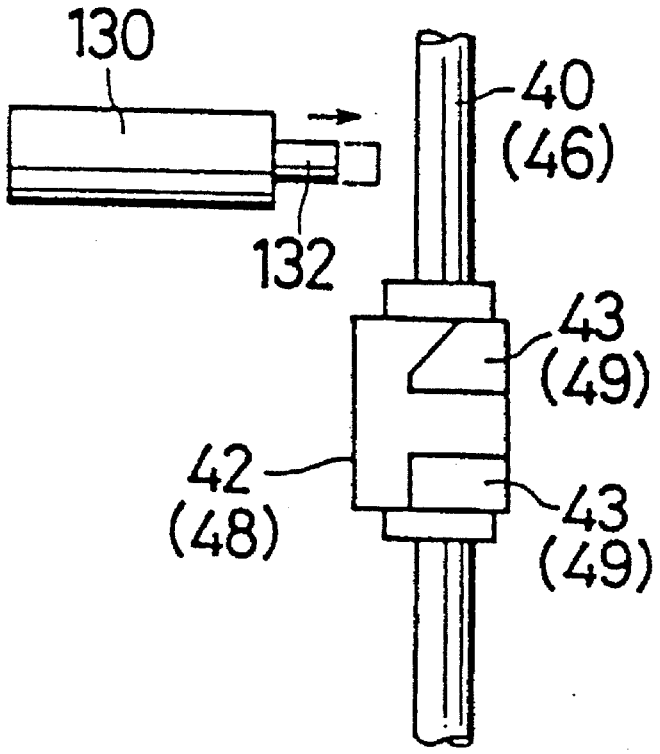
FIG. 12 is a view, looking in the right-hand direction of FIG. 11, of a part of FIG. 11.

FIGS. 11 and 12 show an embodiment incorporating a jumping mechanism on the basis of the construction of the first embodiment. A jumping operation can be performed by temporarily releasing the driving of a needle bar driving mechanism 70 and a presser foot driving mechanism 90.

For this purpose, as for the needle bar driving mechanism, a vertically movable member 41 and a driving member 42 as previously described are mounted on a needle bar base 40 and are movable together along the needle bar base 40 in a vertical direction. The driving member 42 is rotatable around the axis of the needle bar base 40 for disengaging its engagement protrusion 43 from a protrusion 22 of a needle bar 18. A lever 72 is connected to the vertically movable member 41 through a link 74 and pins 75 and 76.

As for the presser foot driving mechanism 90, a guide rod 46 is disposed adjacent a presser foot shaft 52, and a vertically movable member 47 and a driving member 48 are mounted on the guide rod 46 and are movable together along the guide rod 46. A pair of engagement protrusions 49 are formed with the driving member 48 and are in engagement with a pin 54 of the presser foot shaft 52. The driving member 48 can also be rotated around the axis of the guide rod 46 for disengaging the engagement protrusions 49 from the pin 54 of the presser foot shaft 52. A lever 92 of the presser foot driving mechanism as previously described is connected to the vertically movable member 47 through a link 96, and pins 97 and 98.

As shown in FIG. 12, solenoids 130 are disposed adjacent upper dead points of the driving members 42 and 47, respectively. Plungers 132 may extend as shown by a virtual line when the solenoids 130 are excited. The plungers 132 thus extended may contact beveled surfaces 42*a* and 48*a* of the driving members 42 and 48 which have been moved to upward positions, respectively. The driving members 42 and 48 therefore rotate as described above, so that power transmission to the needle bar 18 and the presser foot shaft 52 can be interrupted.

Since it is only necessary to temporarily release at least driving of the needle bar driving mechanism 70 for the jumping operation in embroidery sewing, the jumping operation can also be performed by temporarily stopping the driving source 70C of the needle bar driving mechanism 70 in the first embodiment. However, with such construction, the driving of the needle bars 18 of all of the sewing heads H in the multi-head sewing machine is released. Therefore, it requires to incorporate the aforesaid jumping device for controlling each of the sewing heads in such a manner that any of the sewing heads H can be stopped.

Fifth Embodiment

Figure 13:
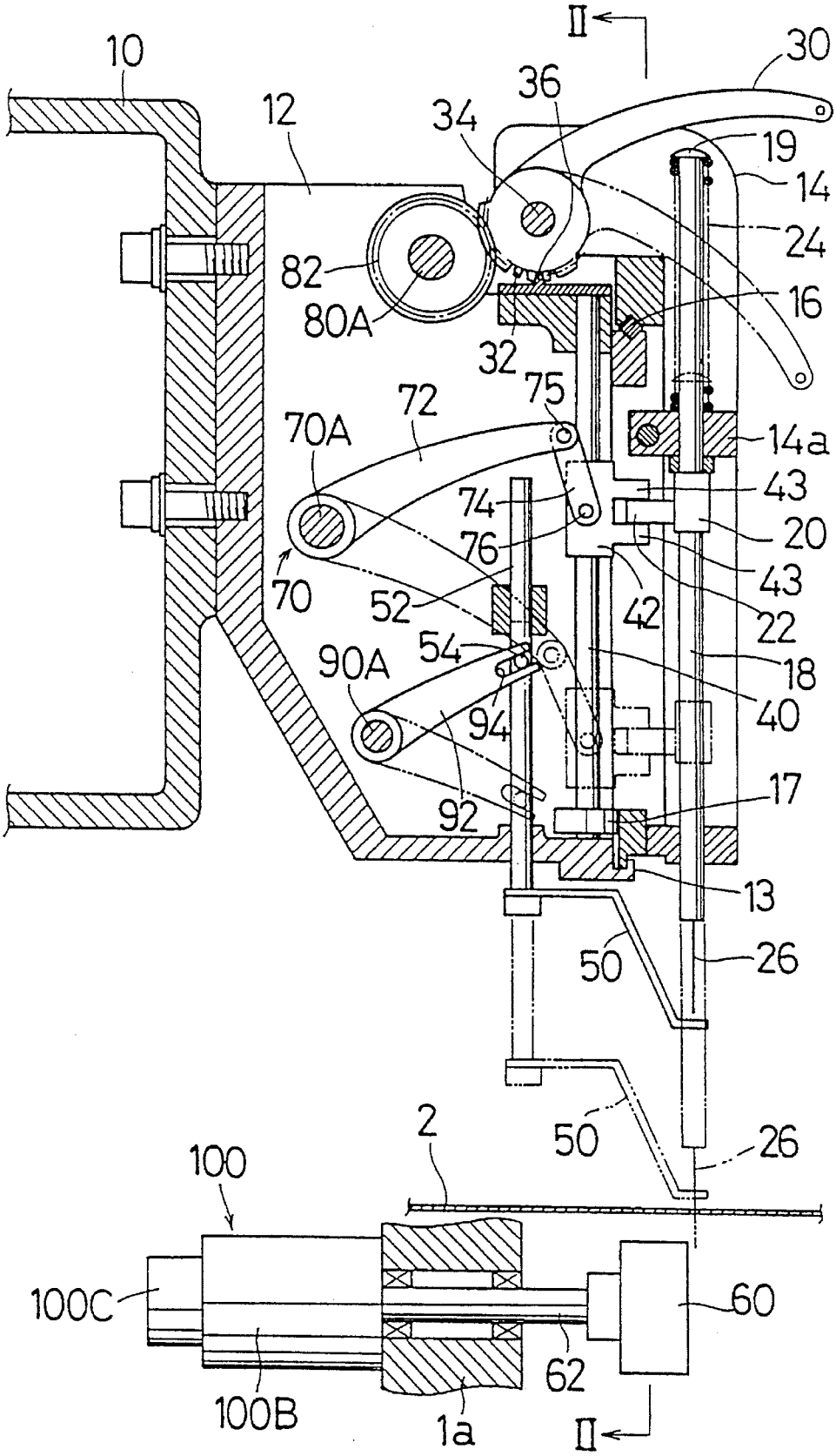
FIG. 13 is a vertical sectional view of a main portion of a sewing head of a fifth embodiment.
Figure 14:
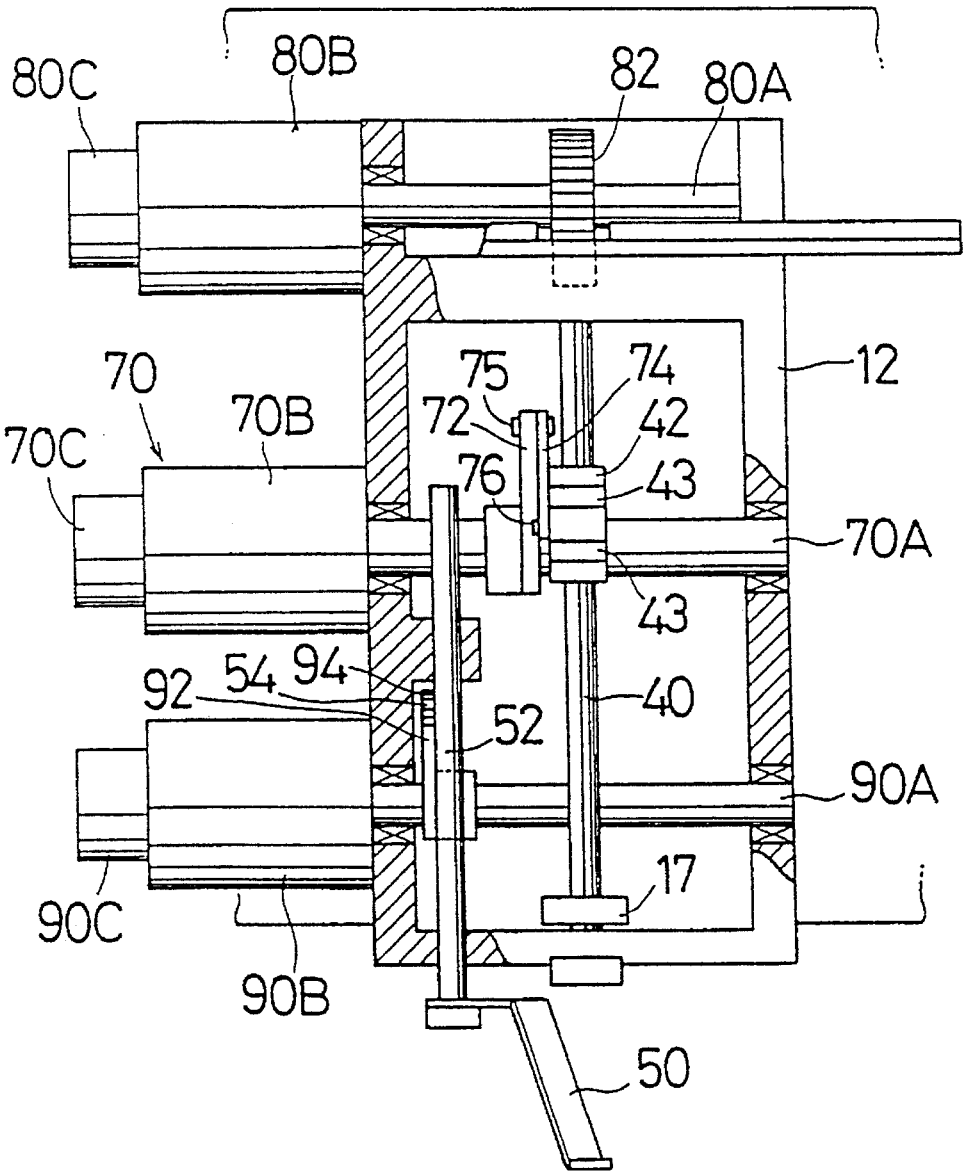
FIG. 14 is a view taken along line II—II in FIG. 13.
Figure 14:
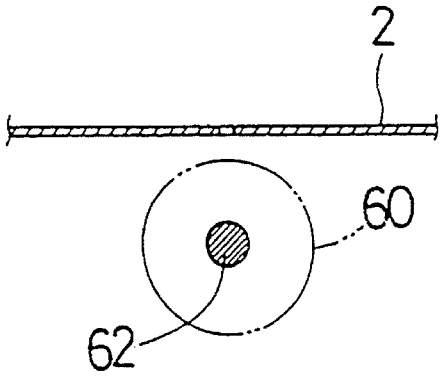

FIG. 13 is a vertical sectional view of a sewing head H according to this embodiment, and FIG. 14 is a sectional view taken along line II—II in FIG. 13. As shown in these figures, the sewing head H is provided with an arm 12 and a needle bar casing 14. The needle bar casing 14 is disposed on the front side (right side in FIG. 13) of the arm 12 and is slidably movable in a lateral direction in FIG. 14 through a radial bearing 17 and a guide portion 13 of the arm 12. The rear portion (left side portion in FIG. 1) of the arm 12 is fixed to the machine frame 10.

A plurality of needle bars 18 (six in this embodiment) are vertically movably mounted on the needle bar case 14 and are spaced from each other in the lateral direction in FIG. 14 at a predetermined distance. A needle bar connecting stud 20 is fixed to the middle portion of each of the needle bars 18 and is provided with a protrusion 22 on the left side in FIG. 13.

A needle bar support spring 24 is interposed between a spring seat 19 disposed at the upper end of each of the needle bars 18 and an upper surface of an upper horizontal frame 14*a* of the needle bar casing 14 for normally biasing the corresponding needle bar 18 in an upward direction. By virtue of the resilient force of the spring 24, each of the needle bars 18 is kept at its upper dead point shown by a solid line in FIG. 13. A sewing needle 26 is mounted on the lower end of each of the needle bar 18.

As shown in FIG. 13, a needle bar base 40 is mounted on the arm 12 and extends in parallel to the needle bars 18. A driving member 42 is vertically movably mounted on the needle bar base 40. A pair of engaging protrusions 43 spaced from each other in the vertical direction are integrally formed with the driving members 42. The protrusion 22 of one of the needle bars 18 selected through aforementioned sliding movement of the needle bar casing 14 relative to the arm 12 is engageable between the engaging protrusions 43.

One end of a lever 72 is connected to the driving member 42 through a link 74 and pins 75 and 76, while the other end of the lever 72 is fixed to a needle bar driving shaft 70A, so that the lever 72 can be rotated with the driving shaft 70A. Thus, as the needle bar driving shaft 70A rotates, the driving member 42 reciprocally vertically moves along the needle bar base 40 and consequently, the needle bar 18 is reciprocally vertically moved.

Thread take-up levers 30 are disposed within the needle bar case 14 at positions corresponding to the needle bars 18, respectively. Each of the thread take-up levers 30 is rotatably mounted on a thread take-up lever shaft 34 supported by the needle bar casing 14 at both ends thereof. Further, each of the thread take-up levers 30 is provided with a gear 32 having the same central axis as that of the thread take-up lever shaft 34.

As for the other thread take-up levers 30 corresponding to the aforementioned selected needle bar 18, a part of the gear 32 of each of them engages a thread take-up lever rail 36 fixed on the upper surface of the arm 12, so that the other thread take-up levers 30 are maintained at positions shown by solid lines in FIG. 13.

A drive gear 82 is fixedly mounted on the driving shaft 80A. A part of the thread take-up rail 36 is notched at a position forwardly of the drive gear 82 (rightwardly in FIG. 13). Thus, only the gear 32 of the thread take-up lever 30 positioned forwardly of the drive gear 82 through selecting operation of the needle bars 18 engages the drive gear 82 and is released from engagement with the thread take-up lever rail 36. Therefore, only the selected thread take-up lever 30 may rotate around the thread take-up lever shaft 34 by the reciprocal rotation of the driving shaft 80A.

A presser foot shaft 52 is vertically movably mounted on the arm 12 at a position rearwardly of the needle bar base 40 (leftward in FIG. 13) and extends in parallel to the needle bar base 40. A presser foot 50 is fixed to the lower end of the presser foot shaft 52 below the arm 12. A pin 54 is fixed to the presser foot shaft 52.

A lever 92 is mounted on the driving shaft 90A of the presser foot driving mechanism 90 in such a manner that it can be rotated with the driving shaft 90A. An engagement recess 94 is formed at one end of the lever 92 and is in engagement with the pin 54 of the presser foot shaft 52. The presser foot 50 moves vertically together with the presser foot shaft 52 by the reciprocal rotation of the driving shaft 90A.

Additionally, as is well known, a shuttle 60 is disposed below a throat plate 2 mounted on the table 1. A hook shaft 62 for rotating the shuttle 60 is rotatably supported by a frame 1*a* below the table 1.

A needle bar driving mechanism 70 and a shuttle driving mechanism 100 will now be explained.

As will be seen from FIG. 14, one end of the needle bar driving shaft 70A is connected to a pulse motor 70B fixedly mounted on an outer surface of the arm 12 so as to receive reciprocal rotational movement from the pulse motor 70B. Thus, the pulse motor 70 constitutes a needle bar driving motor. Further, an absolute encoder 70C is connected to a rotational shaft (not shown) of the pulse motor 70B, and the absolute encoder 70C makes it possible to detect a rotational angle of the pulse motor 70B or to indirectly detect the position of a pointed end of the sewing needle 26.

As will be seen from FIG. 13, with regard to the shuttle driving mechanism 100, one end of a hook shaft 62 is connected to a pulse motor 100B fixedly mounted on the frame 1*a* so as to receive continuous rotational movement in one direction from the pulse motor 100B. Further, an absolute encoder 100C is connected to a rotational shaft (not shown) or the pulse motor 100B, and the absolute encoder 100C makes it possible to detect a rotational angle of the pulse motor 100B or to indirectly detect a rotational angle of a shuttle 60. Thus absolute encoder 100C constitutes a device for detecting the rotational angle of the shuttle.

It will be noted that in the embroidery machine of this embodiment, the thread take-up lever driving shaft 80A and the presser foot driving shaft 90A are independently driven by pulse motors 80B and 90B, respectively.

Figure 15:
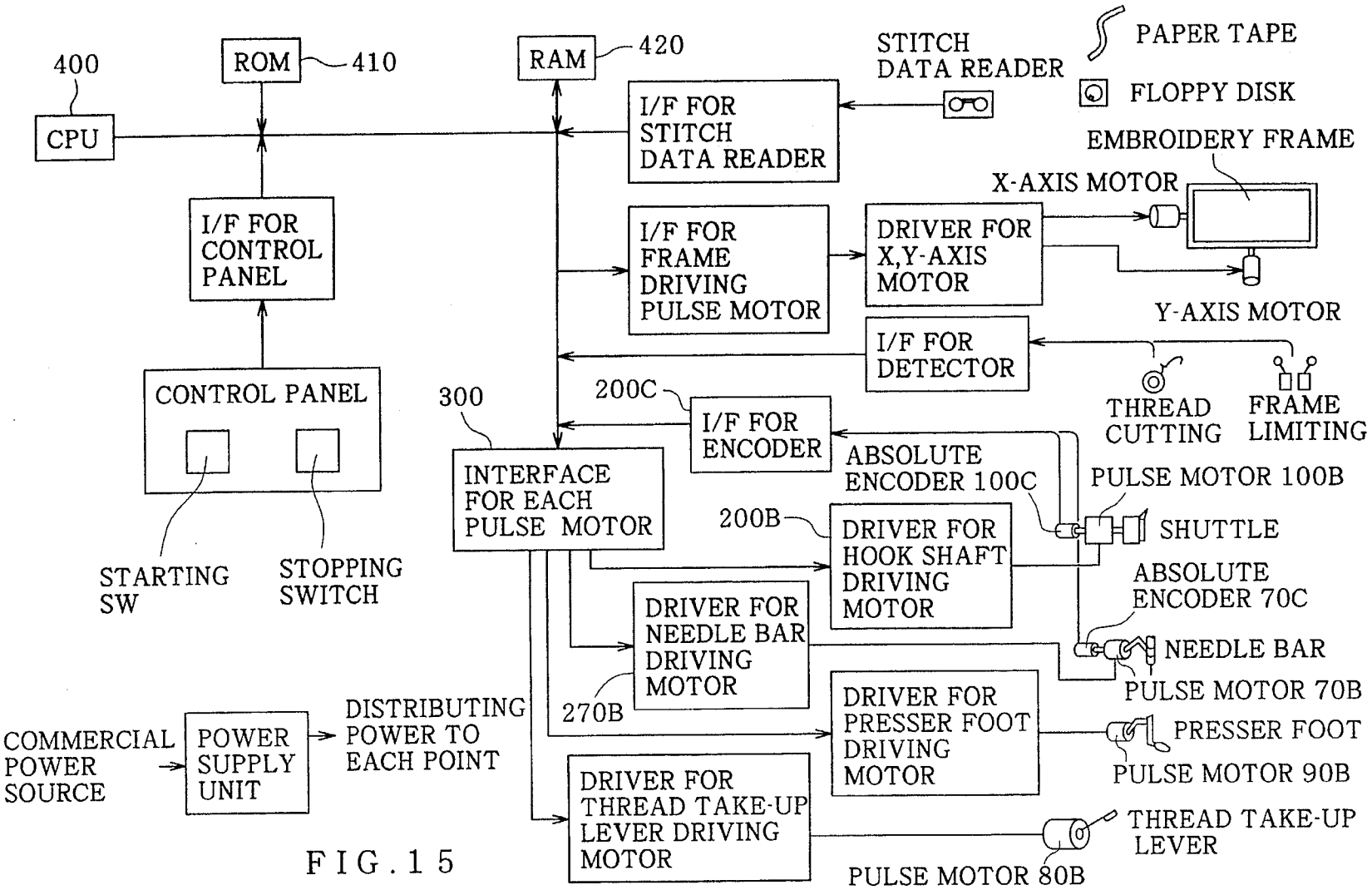
FIG. 15 is a block diagram for controlling an embroidery machine.

FIG. 15 shows a control diagram for one of the sewing heads H according to this embodiment.

When the shuttle 60 is rotated by starting the pulse motor 100B of the shuttle driving mechanism 100 based on a signal from a CPU 400, the rotational angle of the shuttle 60 is detected by the absolute encoder 100C and is inputted to the CPU 400 through an interface 200C for the encoder. Based on the rotational angle of the shuttle 60, the CPU 400 calculates a rotational angle of the pulse motor 70B of the needle bar driving mechanism 70 for controlling the position of the sewing needle 26, and it converts the calculated value to a pulse signal and outputs the same to a driver 270M for the needle bar driving mechanism through an interface 300 for each pulse motor.

Figure 16:
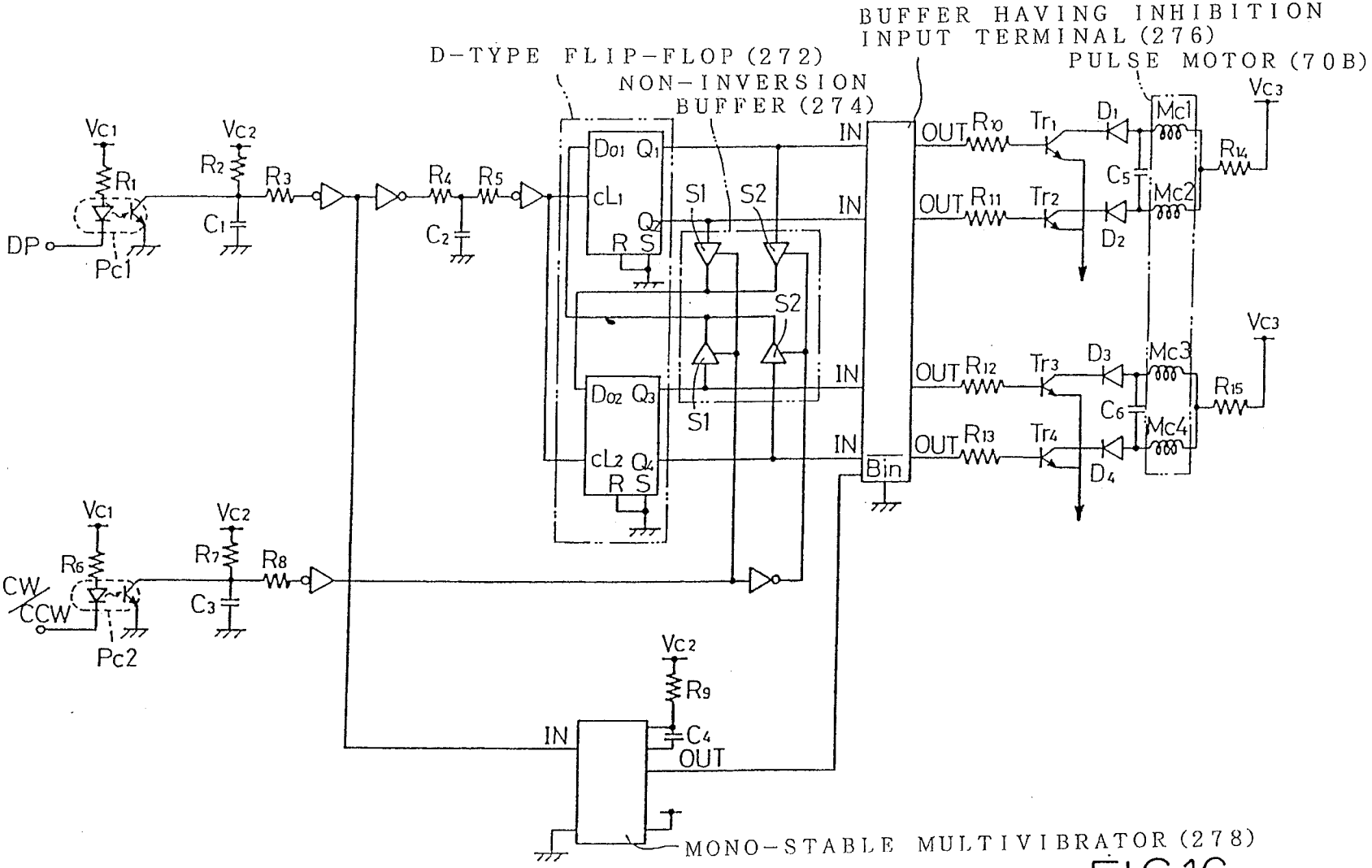
FIG. 16 is a circuit configuration of a needle bar driving mechanism.

Based on the inputted pulse signal, the driver 270B outputs an electric power signal for rotating the pulse motor 70A to a predetermined angle. FIG. 16 shows a circuit configuration of the driver 270B. Since this circuit is one generally utilized as a circuit for driving a motor, a brief explanation will be made.

The pulse signal inputted from a DP terminal is supplied to clock terminals CL1 and CL2 of a D-type flip-flop circuit 272. The D-type flip-flop circuit 272 converts the pulse signal to signals corresponding to the exciting state of each of coils MC1, MC2, MC3 and MC4 of the pulse motor 70B and outputs the same from terminals Q1, Q2, Q3 and Q4. The output signals from the terminals Q1, Q2, Q3 and Q4 are inputted, via a buffer circuit 276, to transistors Tr1, Tr2, Tr3 and Tr4 for supplying power to the coils MC1, MC2, MC3 and MC4, respectively. The state of exciting of each of the coils MC1, MC2, MC3 and MC4 is thus controlled and the pulse motor 70 is rotated step by step to reach the predetermined angle according to the number of the pulses inputted. As for the pulse motor 70B, it is rotated by an angle of 1.8° for one pulse of the pulse signal inputted through the DP terminal.

A mono-stable multivibrator 278 controls (for inhibition or for releasing inhibition) operation of the buffer circuit 276 based on the inputted pulse signal from the DP terminal.

A signal for converting direction of rotation of the pulse motor 70B is inputted to a CW/CC terminal. Upon input of this signal, the state of conduction of S1 and S2 of a non-inversion buffer circuit 274 is inverted and the state of connection of the D-type flip-flop circuit- 272 is changed. The state of exciting of the coils MC1, MC2, MC3 and MC4 with respect to the inputted pulse signal is therefore converted and the direction of rotation of the pulse motor 70B is reversed. Thus, the driver 270B, the interface 300 for each pulse motor and the CPU, etc. function as a motor operating device.

Figure 17:
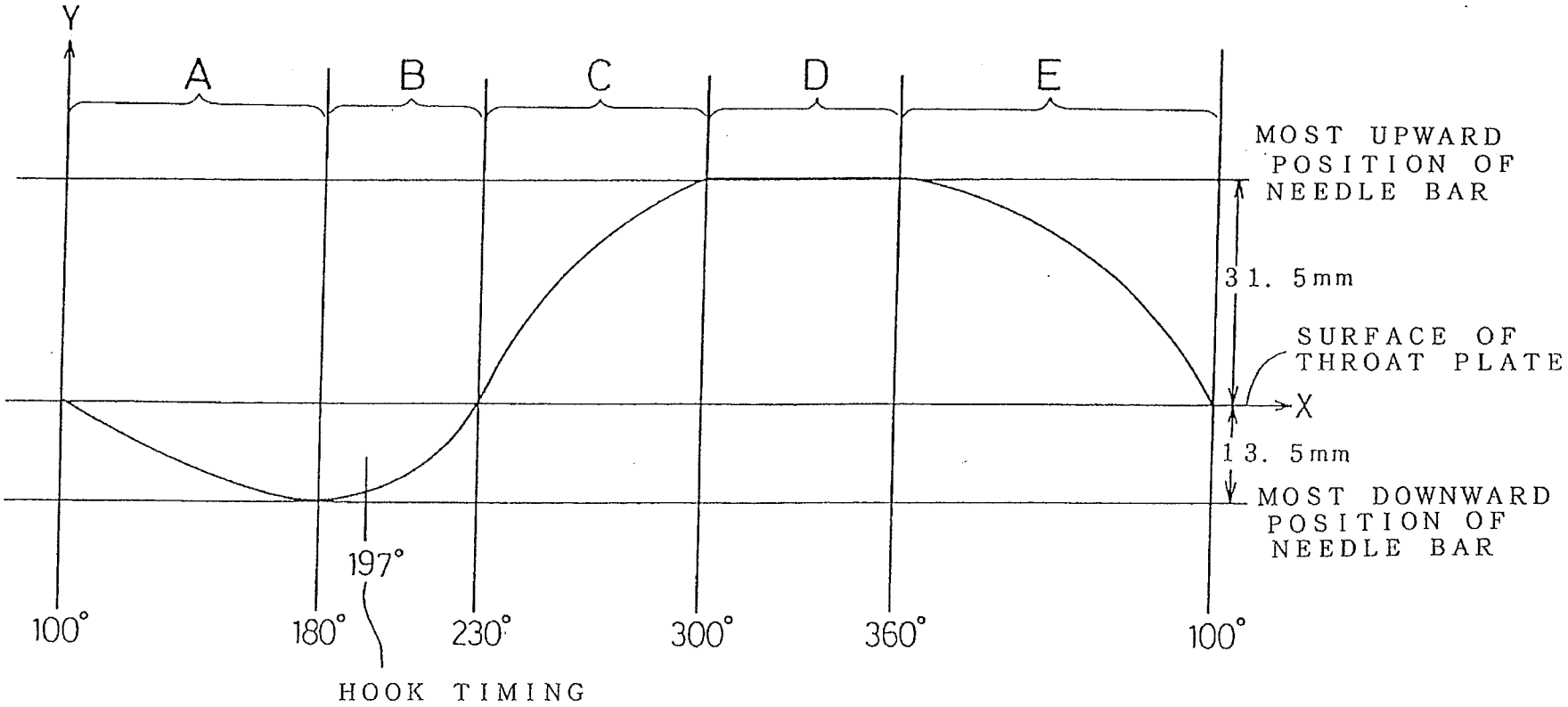
FIG. 17 is a diagram showing the relationship between the rotational angle of a shuttle and the position of a pointed end of a needle.

FIG. 17 shows the relation between rotational angle of the shuttle 60×½ (x) and position of the pointed end of the sewing needle (y). The reason why (x) has been determined as the rotational angle of the shuttle 60×½ is that a hook intersects with the pointed end of the needle at one time for each two revolutions of the shuttle 60 (a hook timing).

For section A or a period of x=101°–180°, the relation between y and x is expressed as follows:

(Mathematical Expression 1)

$$y=\sqrt{Ra^2-(x-Aa)^2}+Ba$$

For a period of x=181°–230° (section B), it is expressed as follows:

(Mathematical Expression 2)

$$y=\sqrt{Rb^2-(x-Ab)^2}+Bb$$

For a period of x=231°–300° (section C), it is expressed as follows:

(Mathematical Expression 3)

$$y=\sqrt{Rc^2-(x-Ac)^2}+Bc$$

For a period of x=301°–360° (section D), it is expressed as follows:

(Mathematical Expression 4)

$$y=Bd=31.5$$

For a period of x=361°–100° (section E), it is expressed as follows:

(Mathematical Expression 5)

$$y=\sqrt{Re^2-(x-Ae)^2}+Be$$

The above expressions (for sections A to B) between the position of the pointed end the needle (y) and the rotational angle of the hook shaft 62×½ are stored in a ROM 410. Based on the above expressions, the CPU 400 calculates the rotational angle of the pulse motor 70B relative to the rotational angle of the hook shaft 62. The parameters Ra–Re, Aa–Ae and Ba–Be are stored in a RAM 420 or the ROM 410 and are freely determined in consideration of the work to be sewn or other conditions.

Therefore, as shown in FIG. 17, the time during which the sewing needle 26 is positioned below the surface of the fabric (sections A, B) or the time between a needle insertion timing and a needle extraction timing (a needle inserting period) can be minimized according to the work to be sewn or other conditions. This may provide enough time for driving the embroidery frame in which its operation is limited during insertion of the sewing needle 26.

Further, it becomes possible to change the maximum rotational angle of the driving shaft 70A of the needle bar driving mechanism 70, so that the stroke of vertical movement of the needle bar 18 can be adjusted. Accordingly, it is possible to improve the efficiency of operation during a sewing operation by determining the lower dead point of the needle bar 18 at a lower position and by limiting the stroke of the same as short as possible, while it is also possible to improve the efficiency of operation during an exchanging operation of the fabric by greatly lifting the needle bar 18.

Additionally, since the pulse motor 70B is provided for each sewing head H, in case that it is not necessary to insert the sewing needle for one of the sewing heads H, it is possible to keep the sewing needle of this one of the sewing heads H extracted during operation of the other of the sewing heads H. Therefore, it is not necessary to provide a jumping device or the like which was required for the conventional machine to keep the needle bar in an idling state.

Figure 18:
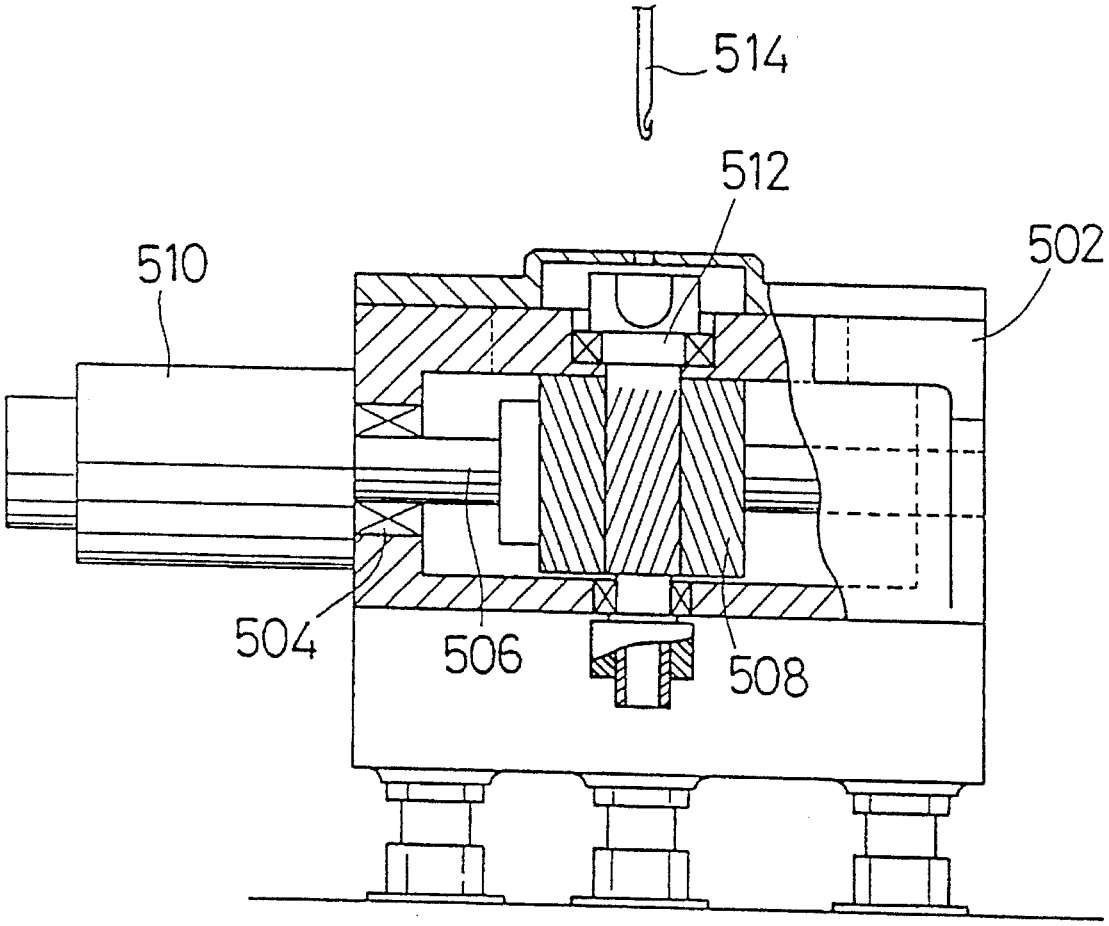
FIG. 18 is a sectional view of a looper driving mechanism of an embroidery machine for loop sewing.

FIG. 18 shows a looper driving mechanism of an embroidery machine for chain stitch sewing with a part broken away. A rotational shaft 506 is disposed within a looper base 502 and is substantially horizontally supported by a bearing 504. A looper driving gear 508 is fixed at substantially the central position of the rotational shaft 506. A pulse motor 510 is connected to one end of the rotational shaft 506, and the rotational shaft 506 and the looper driving gear 508 are rotated by the pulse motor 510 at a predetermined angle around their axes. The looper driving gear 508 engages a looper driven gear 512 having a substantially cylindrical configuration and is supported perpendicular to the rotational shaft 506. A crochet needle 514 is coaxially disposed above the looper driven gear 512. By a driving mechanism (not shown), the crochet needle 514 is vertically driven and is rotated around its axis to adjust the orientation of its crochet portion.

The crochet portion of the crochet needle 514 is adjusted to be oriented in a sewing direction. As the crochet needle 514 is thus rotated, the looper driven gear 512 is rotated by the pulse motor 510 in such a manner that a reference point (not shown) of the looper driven gear 512 is oriented in the same direction as the crochet portion of the crochet needle 514. The crochet needle 512 is subsequently moved downwardly and is inserted into a hollow portion of the looper driven gear 512 through sticking into a fabric to be sewn (not shown). A thread is guided into the hollow portion of the looper driven gear 512 which is rotated by the pulse motor 510 at a predetermined angle so as to round the thread around the crochet needle 514. As the crochet needle 514 is thereafter moved upwardly, the thread is engaged by the chrochet portion and is taken up to reach a position above the fabric to be sewn. At this stage, the fabric to be sewn is moved at a predetermined distance, and the thread is drawn by the length corresponding to this distance. Thereafter, the crochet needle 514 is again moved downwardly so as to be stuck into the fabric to be sewn, resulting in that the thread is disengaged from the hook portion and that only the crochet needle 514 is inserted into the hollow portion of the looper driven gear 512. The looper driven gear 512 is thereafter rotated so as to round another part of the thread around the crochet needle 514. The thread thus newly rounded around the crochet needle 514 is taken up to reach a position above the fabric to be sewn and a stitch previously sewn. The same operation is subsequently repeated to form chain stitch embroidery.

In the conventional machine, although the pulse motor 514 performed control of rotation of the crochet needle 514 to orient its crochet portion in the same direction as that of the reference point of the looper driven gear 512, the rotation of the looper driven gear 512 at the predetermined angle for rounding the thread around the crochet needle 514 is performed by interlocking with rotation of a main shaft of the machine.

By way of contrast, with this embodiment, the rotation of the looper driven gear 512 is completely controlled by the pulse motor 510, so that the machine may have a simple construction. Further, since it is free to determine the rotational angle of the looper driven gear 512 relative to the crochet needle 514 according to the size, hardness and other factors of the thread, the range of selection of the material of the thread becomes broader.

Figure 19:
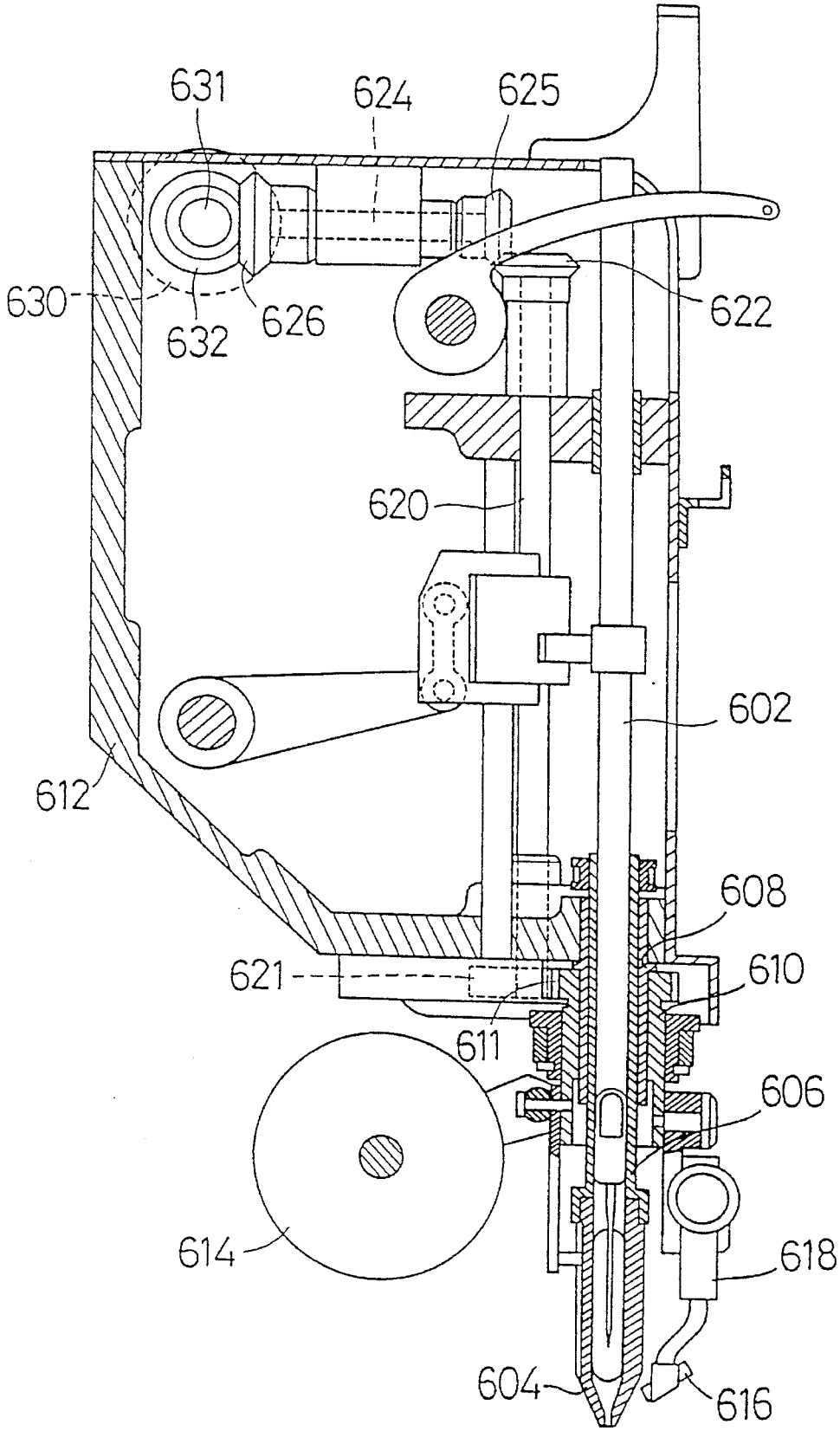

FIG. 19 is a vertical sectional view of an embroidery machine having additional function to sew a tape or a cord (or the like) on a fabric.

A nipple 604 acting as a presser foot and a nipple guide 606 for supporting the nipple 604 are movably mounted on one end of a needle bar 602. The nipple guide 606 is inserted into a nipple sleeve 608 one end of which is fixed to an arm 612. A bushing 610 for rotating a bobbin 614 is mounted on an outer surface of the nipple sleeve 608 and is rotatable around the nipple sleeve 608. A cord or the like is wound around the bobbin 614, and the bobbin 614 and an guide arm 618 are mounted on the bushing 610. The cord or the like wound around the bobbin 614 extends to reach one end of the nipple 604 through a cylindrical cord guide 616 fixed to one end of the guide arm 618.

A gear 611 is formed-on the outer peripheral portion of the upper end of the bushing 610 and engages a vertical shaft lower gear 621 formed on the lower end of a vertical shaft 620. A vertical shaft upper gear 622 is formed on the upper end of the vertical shaft 620 and engages a front end gear 625 of an upper shaft 624. A rear end gear 626 formed on the rear end of the upper shaft 624 engages a gear formed on a drive shaft 631 of a pulse motor 630 fixed to an outer lateral surface of the arm 612. With this construction, rotation of the pulse motor 630 is transmitted to the bushing 610 through the upper shaft 624 and the vertical shaft 620.

For sewing the cord or the like on the fabric, the bushing 61O is rotated according to a sewing pattern, and the rotation of the pulse motor 630 is controlled in such a manner that the cord guide 616 is always oriented toward the sewing direction. The operation of the needle bar 602 is the same as that of an ordinary embroidery machine.

With the conventional machine, only one pulse motor 630 is provided for a plurality of sewing heads H and the rotation of the pulse motor 630 is transmitted to each sewing head H through a shaft. With this embodiment, however, the pulse motor 630 is provided for each sewing head H. Therefore, the operation of driving/stopping for each sewing head H can be freely determined, and the machine may have a simple construction since clutch mechanisms between each of the machine heads as required for the conventional machine are not necessary.

Although the embodiments of the present invention have been described with reference to the drawings, the present invention should not be limited to these embodiments and includes various modifications.

For example, the driving mechanisms 80 and 90 of the second embodiment shown in FIGS. 7 and 8 which are independently driven, respectively, and the driving mechanism 80 of the third embodiment shown in FIGS. 9 and 10 which are independently driven can be replaced by the other driving mechanisms.

What is claimed is:

1. A multi-head embroidery machine comprising:

a machine frame;

a plurality of sewing heads mounted on said machine frame; each of the sewing heads including a needle bar driving mechanism for driving a needle bar, a thread take-up lever driving mechanism for driving a thread take-up lever, a presser foot driving mechanism for driving a presser foot, a shuttle driving mechanism for driving a shuttle;

one shuttle driving mechanism having a driving source which operates independently of other driving sources for the needle bar driving mechanism, the thread take-up lever driving mechanism and the presser foot driving mechanism;

a control device for controlling the driving source of said one shuttle driving mechanism and for controlling the driving sources of the other driving mechanisms as a function of an automatically sensed position of Said one shuttle driving mechanisms so that the other driving sources are simultaneously driven at predetermined timings with the driving timing of the one shuttle driving mechanism taken as a reference; and said control device controlling the position of each thread take-up lever driven by the thread take-up lever driving mechanism as a function of at least one of several factors including the length of stitches, the material of a work to be sewn and the appearance of the embroidery to be obtained so that the tightness of stitches is appropriately adjusted.

2. The multi head embroidery machine as defined in claim 1, said control device further controlling each needle bar driven by the needle bar driving mechanism so that the timing of vertical movement of the needle bar is appropriately adjusted as a function of at least one of several factors including the kind of sewing and the material to be embroidered.

3. The multi-head embroidery machine as defined in claim 1, said control device further controlling each presser foot driven by said presser foot driving mechanism so that the vertical stroke of the presser foot has the minimum required length for the material to be embroidered, whereby the acceleration at the upper and the lower dead points is reduced to minimum values.

4. The multi-head embroidery machine as defined in claim 1 wherein needle bar driving mechanism and shuttle driving mechanism are interlocked with each other but the thread take-up lever driving mechanism and the presser foot driving mechanism are driven independently of the needle bar driving mechanism and the shuttle driving mechanism.

5. A multi-head embroidery machine comprising:

a machine frame;

a plurality of sewing heads mounted on said machine frame; each of the sewing heads including a needle bar driving mechanism for driving a needle bar, a thread take-up lever driving mechanism for driving a thread take-up lever, a presser foot driving mechanism for driving a presser foot, and a shuttle driving mechanism for driving a shuttle;

one shuttle driving mechanism having a driving source operating independently of other driving sources for the needle bar driving mechanism, the thread take-up lever driving mechanism and the presser foot driving mechanism;

a control device for controlling the driving source of said one shuttle driving mechanism and for controlling the driving sources of the other driving mechanisms as a function of an automatically sensed position of said one shuttle driving mechanism so that the other driving sources are simultaneously driven at predetermined timings with the driving timing of the one shuttle driving mechanism taken as a reference;

said control device controlling the position of each thread take-up lever driven by said thread take-up lever driving mechanism as a function of at least one of several factors including the length of stitches, the material of a work to be sewn and appearance of the embroidery so that the tightness of stitches is appropriately adjusted;

said control device controlling the position of each needle bar driven by the needle bar driving mechanism as a function of at least one of several factors including the length of the stitches, the material of a work to be sewn and the appearance of the embroidery so that the timing of the vertical movement of each needle bar is appropriately adjusted; and said control device controlling each presser foot driven by the presser foot driving mechanism in a manner wherein the presser foot vertical stroke is reduced to a minimum required length so that the acceleration at the upper dead point and the lower dead point has a minimum value.

6. The multi-head embroidery machine as defined in claim 5 wherein needle bar driving mechanism and shuttle driving mechanism are interlocked with each other but thread take-up lever driving mechanism and presser foot driving mechanism are driven independently of the needle bar driving mechanism and the shuttle driving mechanism.

7. A multi-head embroidery machine comprising:

a machine frame;

a plurality of sewing heads mounted on said machine frame; each of the sewing heads including a needle bar driving mechanism for driving a needle bar, a thread take-up lever driving mechanism for driving a thread take-up lever, a presser foot driving mechanism for driving a presser foot, a shuttle driving mechanism for driving a shuttle;

a plurality of driving sources, one driving source for each driving mechanism;

a first shuttle driving mechanism having a first driving source operating independently of other driving sources for the needle bar, the thread take-up lever and the presser foot driving mechanism;

a control device for controlling the first driving source of said first shuttle driving mechanism and for controlling the driving sources of the other driving mechanisms as a function of an automatically sensed position of the first shuttle driving mechanism so that the driving sources are simultaneously driven at predetermined timings with the driving timing of the first shuttle driving mechanism taken as a reference; and said control device controlling the position of each thread take-up lever driven by the thread take-up lever driving mechanism as a function of at least one of several factors including the length of stitches, the material of a work to be sewn and the appearance of the embroidery to be obtained so that the tightness of stitches is appropriately adjusted.

8. The multi head embroidery machine as defined in claim 7, wherein said control device also controls the needle bar driven by said needle bar driving mechanism so that the timing of vertical movement of the needle bar is appropriately adjusted as a function of at least one of several factors including the kind of sewing and the material of a work to be embroidered.

9. The multi-head embroidery machine as defined in claim 7 wherein said control device also controls each presser foot driven by the presser foot driving mechanism so that the vertical stroke of the presser foot has the minimum required length for the material to be embroidered, whereby the acceleration at the upper and the lower dead points is reduced to minimum values.

10. The multi-head embroidery machine as defined in claim 7 wherein needle bar driving mechanism and shuttle driving mechanism are interlocked with each other, the thread take-up lever driving mechanism and the presser foot driving mechanism are driven independently.

* * * * *